US012631360B2

(12) United States Patent
Mou et al.

(10) Patent No.: US 12,631,360 B2
(45) Date of Patent: May 19, 2026

(54) INDOOR GAS EXCHANGE SYSTEM

(71) Applicant: MICROJET TECHNOLOGY CO., LTD., Hsinchu City (TW)

(72) Inventors: Hao-Jan Mou, Hsinchu City (TW); Chin-Chuan Wu, Hsinchu City (TW); Yung-Lung Han, Hsinchu City (TW); Chi-Feng Huang, Hsinchu City (TW)

(73) Assignee: MICROJET TECHNOLOGY CO., LTD., Hsinchu City (TW)

( * ) Notice: Subject to any disclaimer, the term of this patent is extended or adjusted under 35 U.S.C. 154(b) by 710 days.

(21) Appl. No.: 18/156,088

(22) Filed: Jan. 18, 2023

(65) Prior Publication Data

US 2024/0151419 A1 May 9, 2024

(30) Foreign Application Priority Data

Nov. 7, 2022 (TW) ..... 111142456

(51) Int. Cl.
*B01D 53/02* (2006.01)
*F24F 8/108* (2021.01)
(Continued)

(52) U.S. Cl.
CPC ..... *F24F 11/63* (2018.01); *F24F 8/108* (2021.01); *F24F 8/15* (2021.01); *F24F 11/39* (2018.01);
(Continued)

(58) Field of Classification Search
CPC ..... A61N 2005/1087; A61N 5/1043; A61N 5/1045; A61N 5/1048; A61N 5/1081;
(Continued)

(56) References Cited

U.S. PATENT DOCUMENTS 11,649,977 B2 * 5/2023 He ..... F24F 11/63 700/276
12,055,306 B2 * 8/2024 Mou ..... F24F 8/108
(Continued)

FOREIGN PATENT DOCUMENTS

CN 107327989 A 11/2017
CN 112413789 A 2/2021
(Continued)

*Primary Examiner* — Christopher P Jones

(74) *Attorney, Agent, or Firm* — Birch, Stewart, Kolasch & Birch, LLP

(57) ABSTRACT

An indoor gas exchange system configured between an outdoor space and an indoor space includes one or more outdoor air pollution detectors, a plurality of indoor air pollution detectors, a gas exchange device, a filtering component, and a central processing controller. The gas exchange device is manufactured by a plurality of gas-guiding units integrated as a thin member through semiconductor manufacturing processes. The gas exchange device is configured between the outdoor space and the indoor space to provide gas exchange for the indoor gas. The central processing controller performs an intelligent computation to control the gas exchange device to be opened or closed and to determine whether the outdoor gas is to be introduced into the indoor space or the indoor gas is to be discharged to the outdoor space, so that the indoor gas in the indoor space is exchanged and cleaned to a safe and breathable state.

18 Claims, 27 Drawing Sheets

(51) Int. Cl.

| | |
|---|---|
| ***F24F 8/15*** | (2021.01) |
| ***F24F 11/39*** | (2018.01) |
| ***F24F 11/54*** | (2018.01) |
| ***F24F 11/58*** | (2018.01) |
| ***F24F 11/63*** | (2018.01) |
| ***F24F 11/72*** | (2018.01) |
| ***F24F 11/88*** | (2018.01) |
| *F24F 11/00* | (2018.01) |
| *F24F 110/52* | (2018.01) |
| *F24F 110/66* | (2018.01) |
| *F24F 110/70* | (2018.01) |
| *F24F 140/40* | (2018.01) |

(52) U.S. Cl.
CPC ..... *F24F 11/54* (2018.01); *F24F 11/58* (2018.01); *F24F 11/72* (2018.01); *F24F 11/88* (2018.01); *F24F 2011/0002* (2013.01); *F24F 2110/52* (2018.01); *F24F 2110/66* (2018.01); *F24F 2110/70* (2018.01); *F24F 2140/40* (2018.01); *F24F 2221/36* (2013.01)

(58) Field of Classification Search
CPC ..... F24F 11/0001; F24F 11/39; F24F 11/54; F24F 11/58; F24F 11/63; F24F 11/72; F24F 11/88; F24F 2011/0002; F24F 2110/50; F24F 2110/52; F24F 2110/65; F24F 2110/66; F24F 2110/70; F24F 2140/40; F24F 2221/36; F24F 7/08; F24F 8/108; F24F 8/15
See application file for complete search history.

(56) References Cited

U.S. PATENT DOCUMENTS

| | | | | |
|---|---|---|---|---|
| 12,435,890 | B2 * | 10/2025 | Mou | B01D 46/429 |
| 2020/0224915 | A1 * | 7/2020 | Nourbakhsh | F24F 11/54 |
| 2021/0063036 | A1 * | 3/2021 | Oh | G06V 10/764 |
| 2022/0364748 | A1 * | 11/2022 | Mou | B01D 46/0043 |
| 2023/0235899 | A1 * | 7/2023 | Mou | F24F 8/108 95/8 |
| 2023/0235910 | A1 * | 7/2023 | Mou | F24F 7/007 422/1 |
| 2025/0129963 | A1 * | 4/2025 | Mou | F24F 8/108 |
| 2025/0264243 | A1 * | 8/2025 | Mou | F24F 11/77 |

FOREIGN PATENT DOCUMENTS

| | | | |
|---|---|---|---|
| TW | I753559 | B | 1/2022 |
| TW | 202242320 | A | 11/2022 |

* cited by examiner

72

INDOOR GAS EXCHANGE SYSTEM

CROSS-REFERENCE TO RELATED APPLICATION

This non-provisional application claims priority under 35 U.S.C. § 119(a) to Patent Application No. 111142456 filed in Taiwan, R.O.C. on Nov. 7, 2022, the entire contents of which are hereby incorporated by reference.

BACKGROUND

Technical Field

The present invention relates to an indoor gas exchange system, in particular, to an indoor gas exchange system configured between an outdoor space and an indoor space to perform gas exchange.

Related Art

In light of people paying more and more attention to the ambient air quality in daily life, it is noted that the particulate matters (PM1, PM2.5, PM10) around the air including carbon dioxide, total volatile organic compounds (TVOC), formaldehyde and even particulates, aerogels, bacteria, viruses contained in the air might affect the human health, even might be life-threatening when exposure to these gases.

The affecting factors of the indoor air quality include not only the outdoor space air quality but also the air conditioning and the pollution source in the indoor space, especially the dusts, carbon dioxide, and formaldehyde originated from poor circulation of gas in the indoor space, or even the gas may contain bacteria and viruses. Therefore, in order to solve the air pollution source in the indoor space, a common approach is to utilize an air exchange system, such as a heating, ventilation and air conditioning system (HVAC) to achieve the indoor air exchange and filtering, making the indoor gas in the indoor space to be cleaned into a safe and breathable state.

However, as to an exchange system known to the art, the system is connected to the pipelines of the indoor space through a flow-guiding device in a large mechanical configuration so as to achieve the indoor air exchange and filtering. However, configuring the flow-guiding device in a large mechanical configuration is costly and the flow-guiding device in a large mechanical configuration occupies a large space in the indoor space. Therefore, it is a major object in the present invention to build up an electronic- and micro-air exchange system to allow the indoor air pollution to be exchanged and filtered to a safe and breathable state.

SUMMARY

One object of one or some embodiments of the present invention is to propose an indoor gas exchange system, in the indoor gas exchange system, a gas exchange device is manufactured by a plurality of gas-guiding units which are integrated as a thin member through semiconductor manufacturing processes, and the gas exchange device is configured between the outdoor space and the indoor space to provide gas exchange for the indoor space and the outdoor space. Moreover, with at least one outdoor air pollution detector and a plurality of indoor air pollution detectors, outdoor air pollution data and indoor air pollution data are transmitted to a central processing controller. The central processing controller performs an intelligent computation to control the gas exchange device to be opened or closed, and the central processing controller determines whether the outdoor gas is to be introduced into the indoor space or the indoor gas is to be discharged to the outdoor space, so that the indoor gas in the indoor space is exchanged and cleaned to a safe and breathable state.

In order to accomplish the above object(s), in one general embodiment of the present invention, an indoor gas exchange system configured between an outdoor space and an indoor space includes at least one outdoor air pollution detector, a plurality of indoor air pollution detectors, a gas exchange device, a filtering component, and a central processing controller. The at least one outdoor air pollution detector is disposed in the outdoor space and configured to detect a qualitative property and a concentration of an air pollution of an outdoor gas and output an outdoor air pollution data. The indoor air pollution detectors are disposed in the indoor space and configured to detect a qualitative property and a concentration of an air pollution of an indoor gas and output an indoor air pollution data. The gas exchange device is manufactured by a plurality of gas-guiding units, and the gas-guiding units are integrated as a thin member through semiconductor manufacturing processes, wherein the gas exchange device is configured between the outdoor space and the indoor space to provide gas exchange for the indoor gas and the outdoor gas. The filtering component is disposed at a gas-guiding end of the gas exchange device, so that the outdoor gas is cleaned and enters the indoor space. The central processing controller is configured to receive the outdoor air pollution data and the indoor air pollution data, performing an intelligent computation to control the gas exchange device to be opened or closed and determine whether the outdoor gas is to be introduced into the indoor space or the indoor gas is to be discharged to the outdoor space, thereby the indoor gas in the indoor space is exchanged and cleaned to a safe and breathable state.

BRIEF DESCRIPTION OF THE DRAWINGS

The invention will become more fully understood from the detailed description given herein below, and the drawings are provided for illustrating the exemplary embodiment only but not the limitation of the invention, wherein.

DETAILED DESCRIPTION

The present invention will now be described more specifically with reference to the following embodiments. It is to be noted that the following descriptions of different embodiments of this invention are presented herein for purpose of illustration and description only, and it is not intended to limit the scope of the present invention. Moreover, in the following descriptions, for the sake of convenience, the micro electromechanical systems (MEMS) pump can be briefed as pump, and the MEMS pump can be replaced with any types of pumps for different application scenarios. A person having ordinary skills in the art upon referring the description of the present application can modify the pump according to the practical situation.

Figure 1:
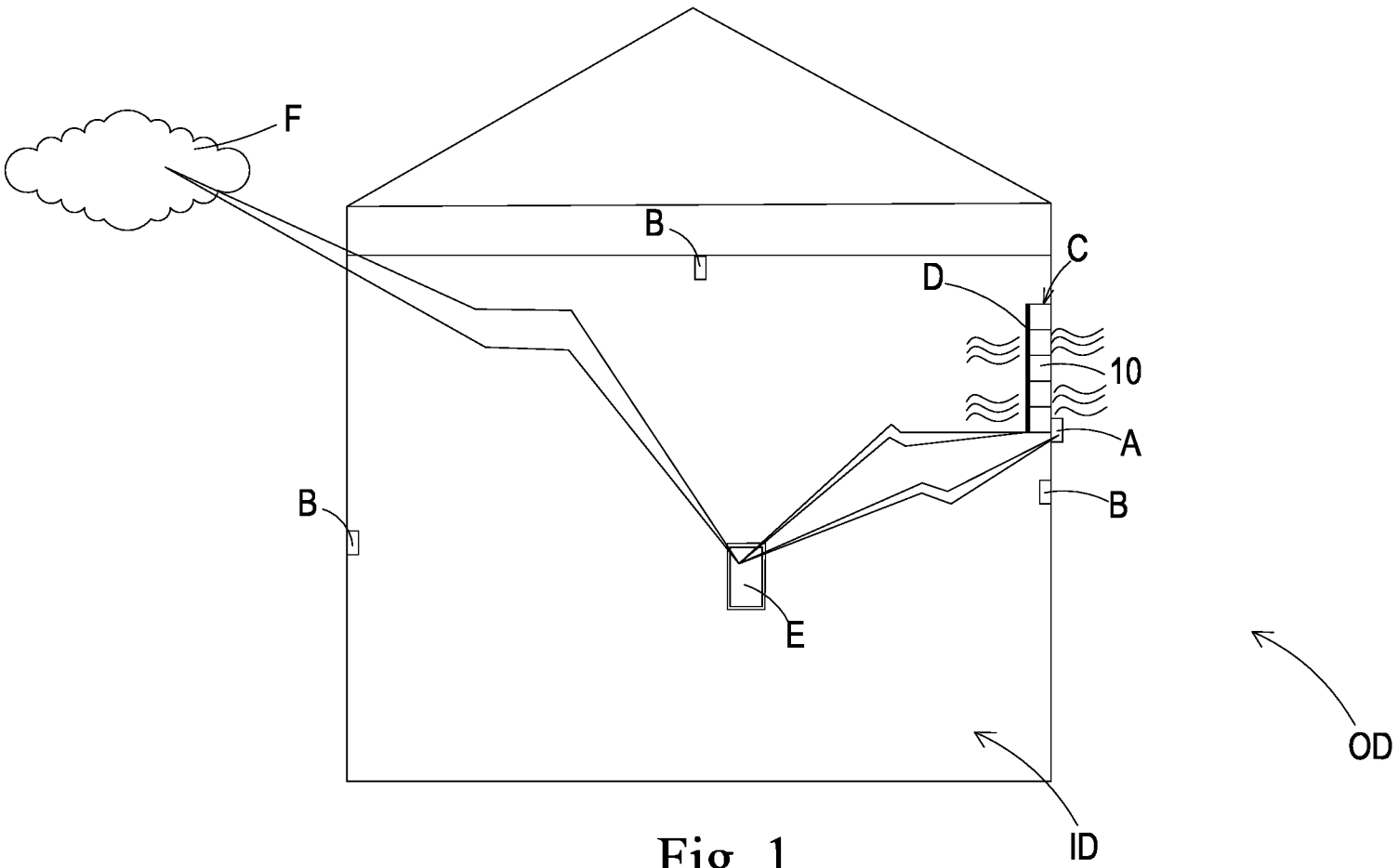
FIG. 1 illustrates a schematic view showing the exemplary embodiment of operation of an indoor gas exchange system of an exemplary embodiment in the present invention, wherein the system is utilized in an indoor space.
Figure 2A:
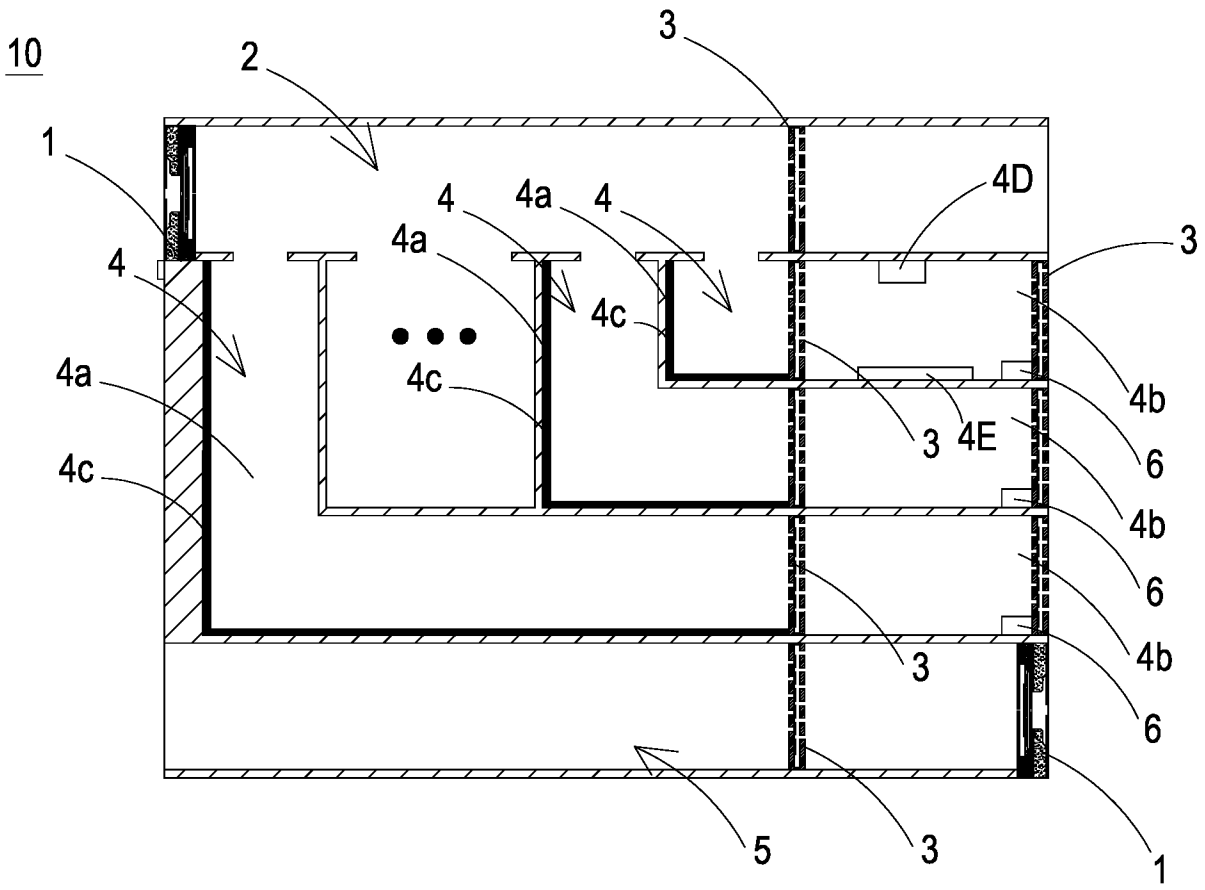
FIG. 2A illustrates a schematic view of a gas-guiding unit of an exemplary embodiment in the present invention.
Figure 2B:
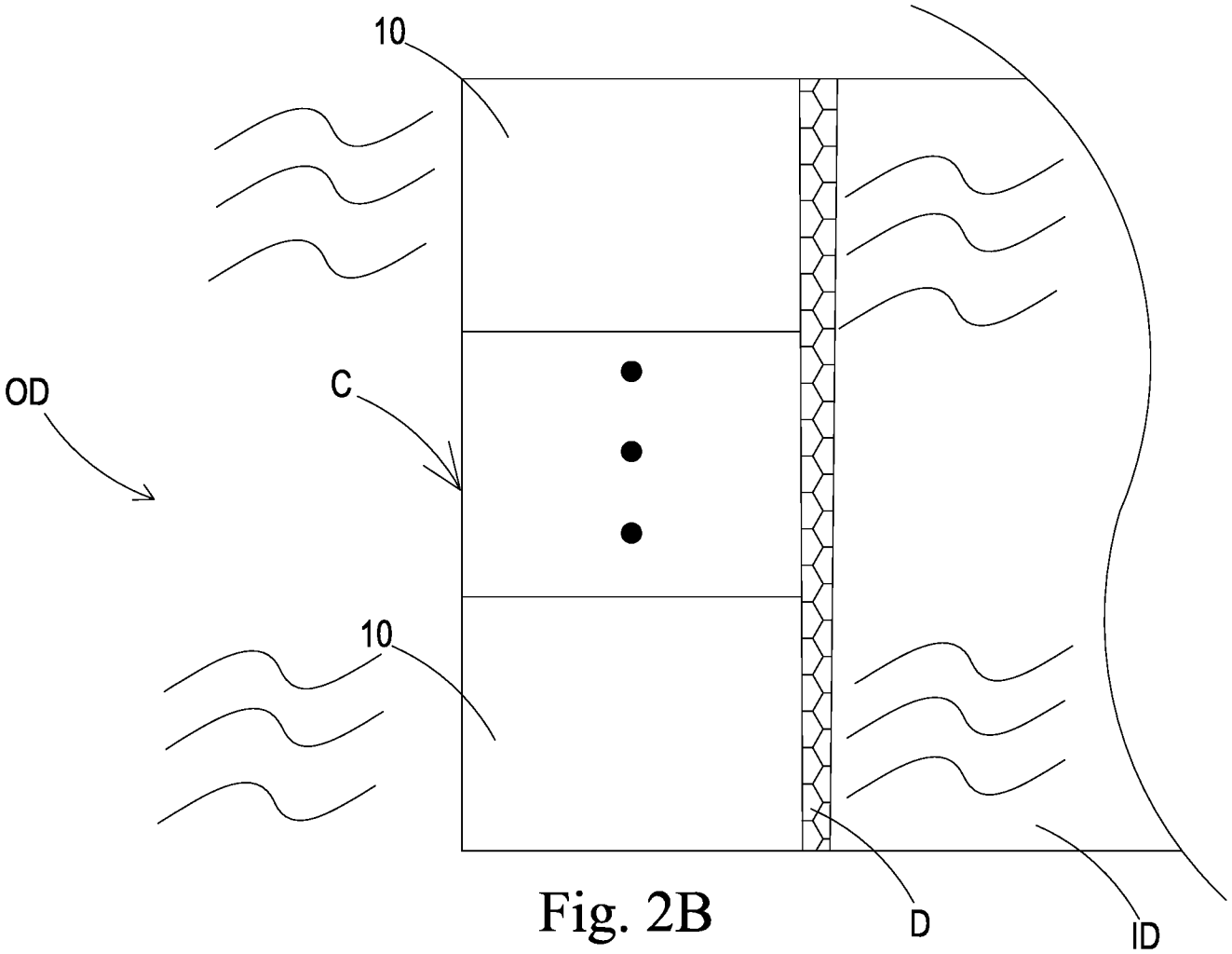
FIG. 2B illustrates a schematic enlarged view showing a gas exchange device in the present invention is configured between an outdoor space and an indoor space.

Please refer to FIG. 1, FIG. 2A, and FIG. 2B, according to one or some embodiments of the present invention, an indoor gas exchange system configured between an outdoor space OD and an indoor space ID is provided. The system includes at least one outdoor air pollution detector A, a plurality of indoor air pollution detectors B, a gas exchange device C, a filtering component D, and a central processing controller E.

The outdoor air pollution detector A is disposed in the outdoor space OD, and the outdoor air pollution detector A is configured to detect a qualitative property and a concentration of an air pollution of an outdoor gas and output an outdoor air pollution data.

The indoor air pollution detectors B are disposed in the indoor space ID, and the indoor air pollution detectors B are configured to detect a qualitative property and a concentration of an air pollution of an indoor gas and output an indoor air pollution data.

The gas exchange device C is manufactured by a plurality of gas-guiding units 10, and the gas-guiding units 10 are integrated as a thin member through semiconductor manufacturing processes. The gas exchange device C is configured between the outdoor space OD and the indoor space ID to provide gas exchange for the indoor gas.

The filtering component D is disposed at a gas-guiding end of the gas exchange device C, therefore, the filtered and cleaned gas can enter the indoor space ID by passing through the filtering component D in order to filter the gas.

The central processing controller E is configured to receive the outdoor air pollution data and the indoor air pollution data, Wherein the central processing controller E is configured to perform an intelligent computation according to the outdoor air pollution data and the indoor air pollution data to control the gas exchange device C to be opened or closed, furthermore, the central processing controller E is configured to determine whether the outdoor gas is to be introduced into the indoor space ID or the indoor gas is to be discharged to the outdoor space OD, thus the indoor gas in the indoor space is exchanged and cleaned to a safe and breathable state.

It is noted that, the air pollution (namely the polluted gas) may include at least one selected from the group consisting of particulate matters, carbon monoxide (CO), carbon dioxide ($CO_2$), ozone ($O_3$), sulfur dioxide ($SO_2$), nitrogen dioxide ($NO_2$), lead (Pb), total volatile organic compounds (TVOC), formaldehyde (HCHO), bacteria, fungi, viruses, and any combination thereof. The outdoor air pollution data and the indoor air pollution data are transmitted through a wireless communication, and the wireless communication is implemented by a Wi-Fi module, a Bluetooth module, a radiofrequency identification module, or a near field communication module.

The gas exchange device C is manufactured by a plurality of gas-guiding units 10, and the gas-guiding units 10 are integrated as a thin member through semiconductor manufacturing processes. The outdoor space OD and the indoor space ID are in communication with each other through the gas-guiding units 10, so that the gas exchange device C allows the gas exchange for the indoor space ID and the outdoor space OD. The gas-guiding unit 10 includes a plurality of pumps 1, a processing channel 2, a plurality of gates 3, a plurality of gas separation channels 4, and a ventilation channel 5.

One of the pumps 1 and one of the gates 3 are disposed in the processing channel 2. In some embodiment of the present invention, the pump 1 guides the outdoor gas in the outdoor space OD to be introduced into the processing channel 2, and the central processing controller E receives the outdoor air pollution data and the indoor air pollution data to perform the intelligent computation so as to control an operation of the pump 1, as well as to control the gate 3 to be opened or closed, and to determine whether the outdoor gas is to be introduced into the indoor space ID through the processing channel 2.

One of the pumps 1 and one of the gates 3 are disposed in the ventilation channel 5. The pump 1 guides the indoor gas in the indoor space ID to be introduced into the ventilation channel 5, and the central processing controller E receives the outdoor air pollution data and the indoor air pollution data to perform the intelligent computation in order to control an operation of the pump 1, as well as to control the gate 3 to be opened or closed, and to determine whether the indoor gas is to be discharged to the outdoor space through the ventilation channel 5. Therefore, the indoor gas in the indoor space ID is exchanged and cleaned to a safe and breathable state.

It is worth to note that, the central processing controller E receives the outdoor air pollution data and the indoor air pollution data to perform the intelligent computation by connecting to a cloud processing device F so as to perform artificial intelligent (AI) computation and big data comparison. The cloud processing device F transmits a control command intelligently and selectively to the central processing controller E to control the operation of the pump 1 in the processing channel 2 and the gate 3 in the processing channel 3 to be opened or closed. In this embodiment, the pump 1 is an MEMS pump.

Figure 3A:
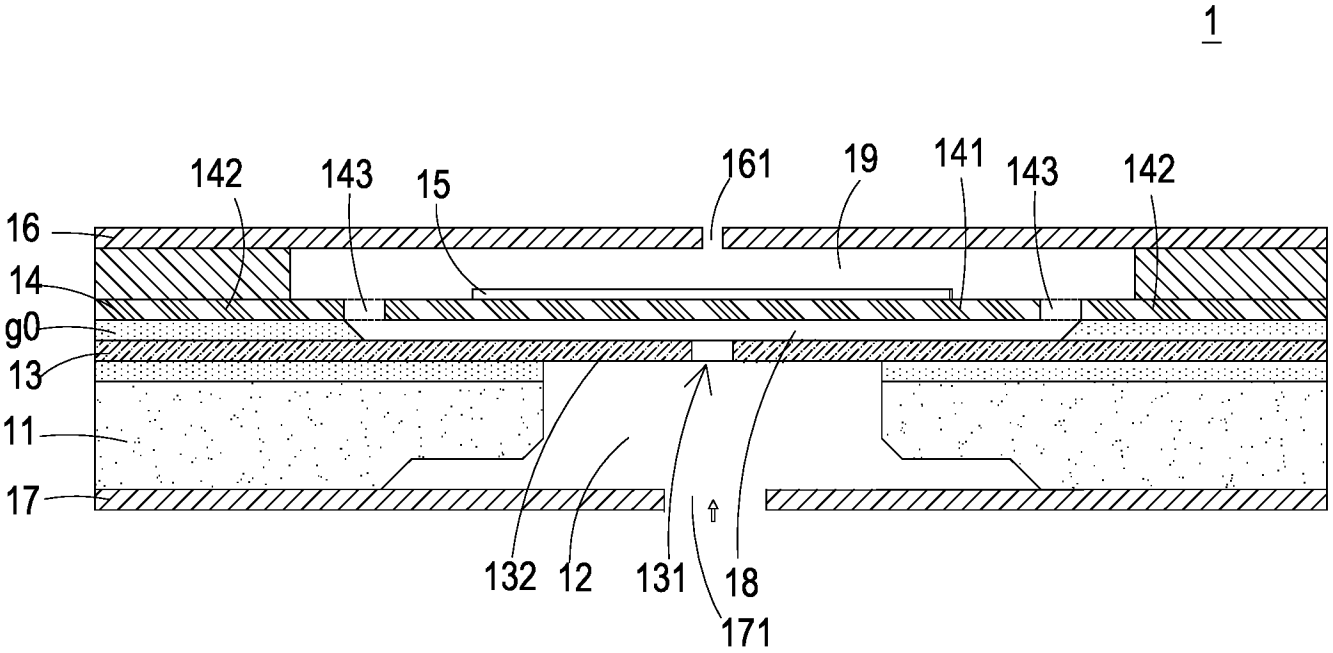
FIG. 3A illustrates a schematic view of a pump in the present invention.

The operation of the MEMS pump is described in the following paragraphs, Please refer to FIG. 3A, The MEMS pump includes a substrate 11, a resonance plate 13, an actuating plate 14, a piezoelectric component 15, and an outlet plate 16 which are stacked sequentially to form a main body. An inlet plate 17 is provided to cover the bottom of the substrate 11 of the main body so as to assemble the MEMS pump. The substrate 11 may be a plate made of a silicon material or a graphene material. A convergence chamber 12 penetrating through the substrate 11 is formed by a semiconductor process. The inlet plate 17 covers the bottom of the substrate 11 and includes at least one inlet 171 in communication with the convergence chamber 12 correspondingly. The resonance plate 13 may be a flexible plate wherein the resonance plate 13 is attached, stacked, and fixed on the top of the substrate 11. The resonance plate 13 includes a central aperture 131 aligned with the convergence chamber 12. A portion of the resonance plate 13 not attaching to the substrate 11 is a movable portion 132, and the movable portion 132 is subject to a bending deformation in response to a resonance frequency. The actuating plate 14 is a plate structure and includes a suspension portion 141, an outer frame 142, and at least one clearance 143. The suspension portion 141 is connected to the outer frame 142 and located at a middle region of the actuating plate 14, so that the suspension portion 141 is suspended and elastically supported by the outer frame 142. The clearances 143 are formed at unconnected portions between the suspension portion 141 and the outer frame 142. The outer frame 142 of the actuating plate 14 is attached, stacked, and fixed on the resonance plate 13. A gap g0 is defined between the suspension portion 141 and the resonance plate 13 so as to form a first chamber 18. The suspension portion 141 may be any geometric shape. Preferably, but not exclusively, the suspension portion 141 is squared. The piezoelectric component 15 is a plate structure made of a piezoelectric material and attached to a surface of the suspension portion 141 of the actuating plate 14. The size of the piezoelectric component 15 is slightly smaller than the size of the suspension part 141. The outlet plate 16 is attached and stacked on the outer frame 142 of the actuating plate 14 by a filler (e.g., a conductive adhesive), so that a second chamber 19 is formed between the outlet plate 16 and the actuating plate 14. The outlet plate 16 includes an outlet 161 in communication with the second chamber 19.

Figure 3B:
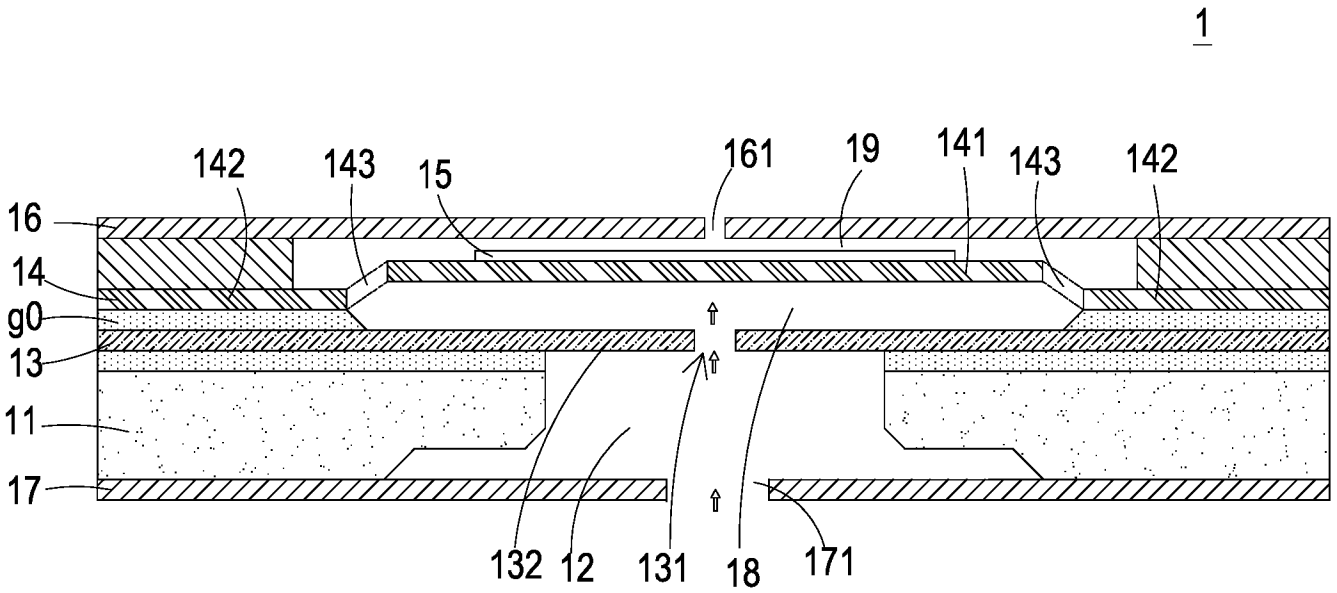
FIG. 3B to FIG. 3D illustrate cross-sectional views showing the operations of the pump in the present invention.
Figure 3C:
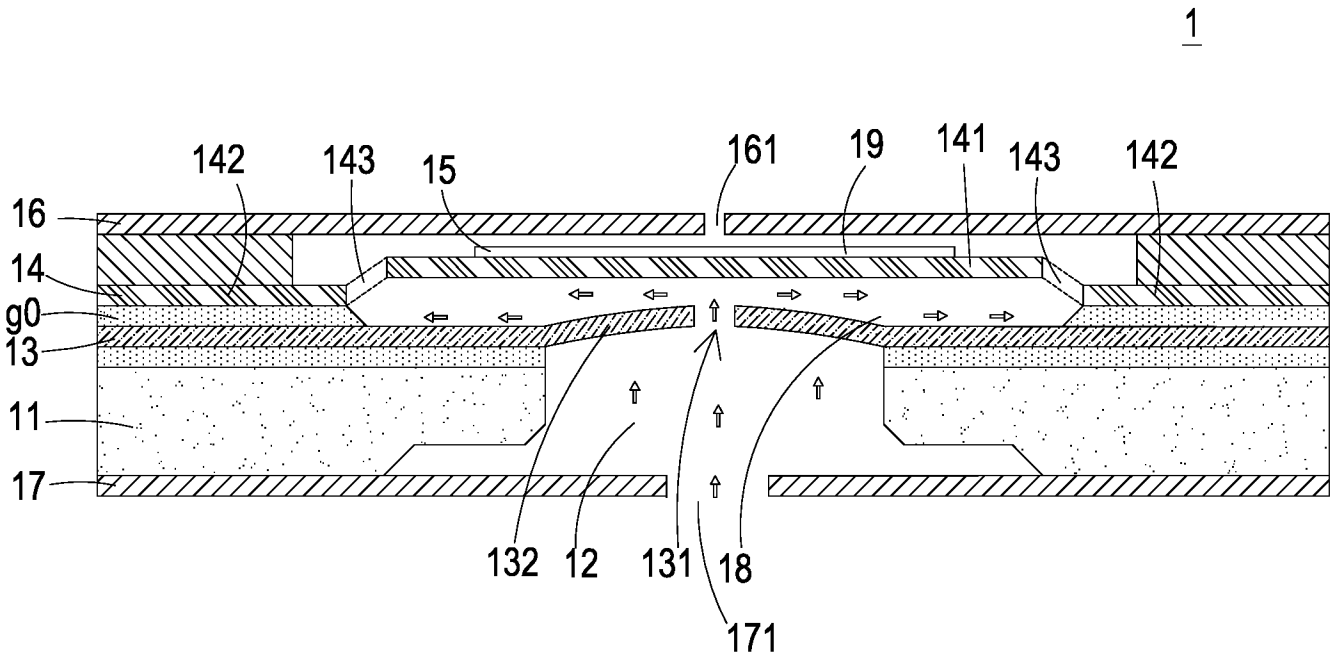
Figure 3D:
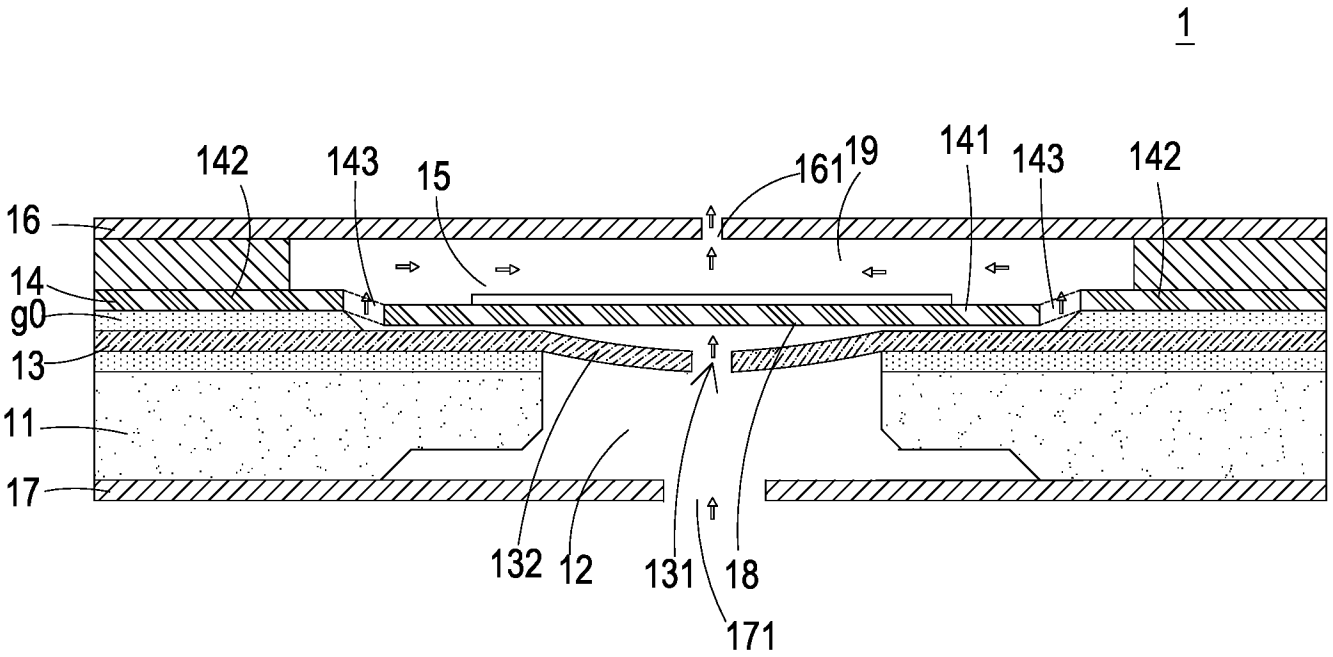

Please refer to FIG. 3B to FIG. 3D. When the piezoelectric component 15 is enabled in response to a voltage to drive the actuating plate 14 to generate a bending vibration in resonance, the actuating plate 14 vibrates along a vertical direction in a reciprocating manner. When the actuating plate 14 vibrates upwardly, the volume of the first chamber 18 is increased and a suction force is generated accordingly for allowing the gas from an environment outside the MEMS pump to be inhaled into the convergence chamber 12 through the inlet 171. Meanwhile, the gas in the second chamber 19 is compressed and discharged out through the outlet 161. Moreover, as shown in FIG. 3C, when the vibration of the actuating plate 14 drives the resonance plate 13 to vibrate in resonance, the movable portion 131 of the resonance plate 13 generates an upward deformation that allows the gas to flow into the first chamber 18 through the central aperture 130 of the resonance plate 13. Meanwhile, the gas is compressed and pushed toward a peripheral region of the first chamber 18. As shown in FIG. 3D, when the actuating plate 14 vibrates downwardly, the first chamber 18 is compressed, and the volume of the first chamber 18 is decreased, so that the gas flows upwardly into the second chamber 19 through the clearances 143. By repeating the operation illustrated in FIG. 3B, the gas in the second chamber 19 is compressed and discharged out through the outlet 161, so that the gas from the environment outside the MEMS pump can be introduced into the convergence chamber 12 again. By repeating the operations of the MEMS pump described above in FIG. 3B to FIG. 3D, the gas transportation can be performed continuously.

Figure 4A:
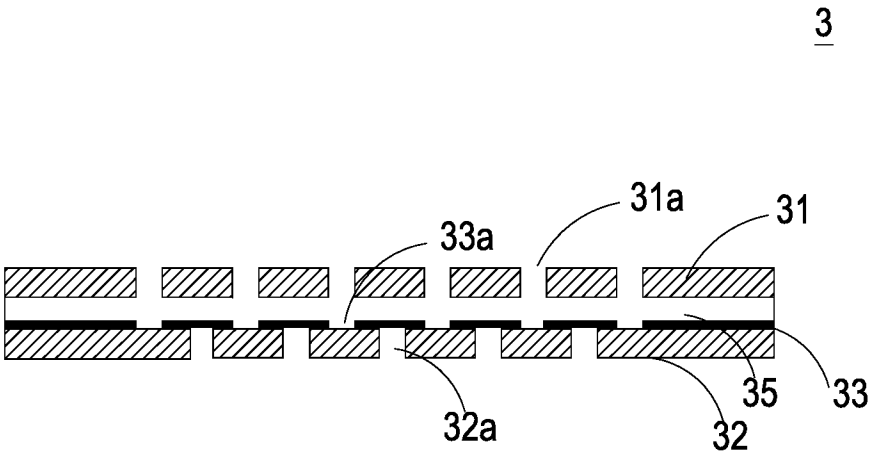
FIG. 4A illustrates a schematic view of a gate in the present invention.
Figure 4B:
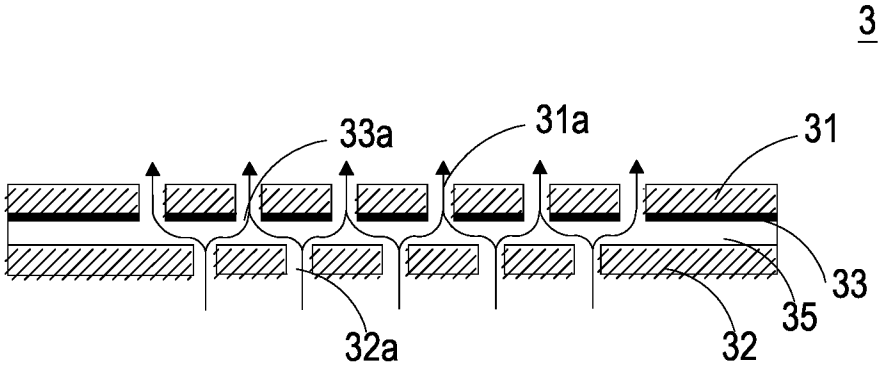
FIG. 4B illustrates a schematic view showing the operation of the gate in the present invention.
Figure 5A:
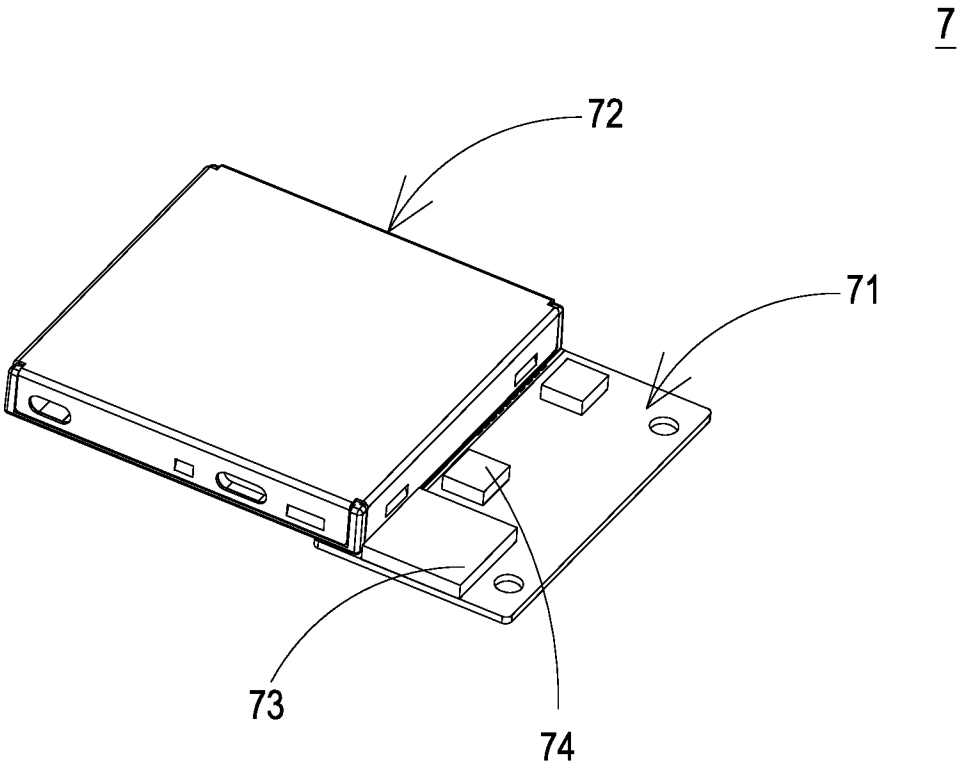
FIG. 5A illustrates a perspective view of an air pollution detector in the present invention.
Figure 5B:
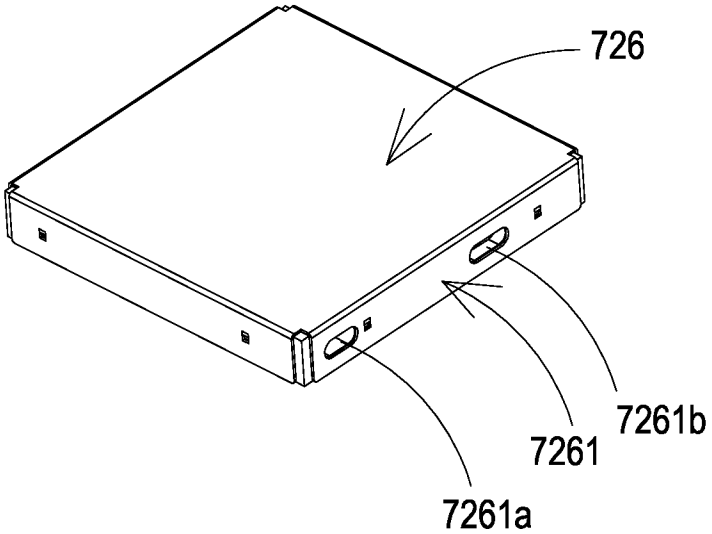
FIG. 5B illustrates a front perspective view of a gas detection main body in the present invention.
Figure 5C:
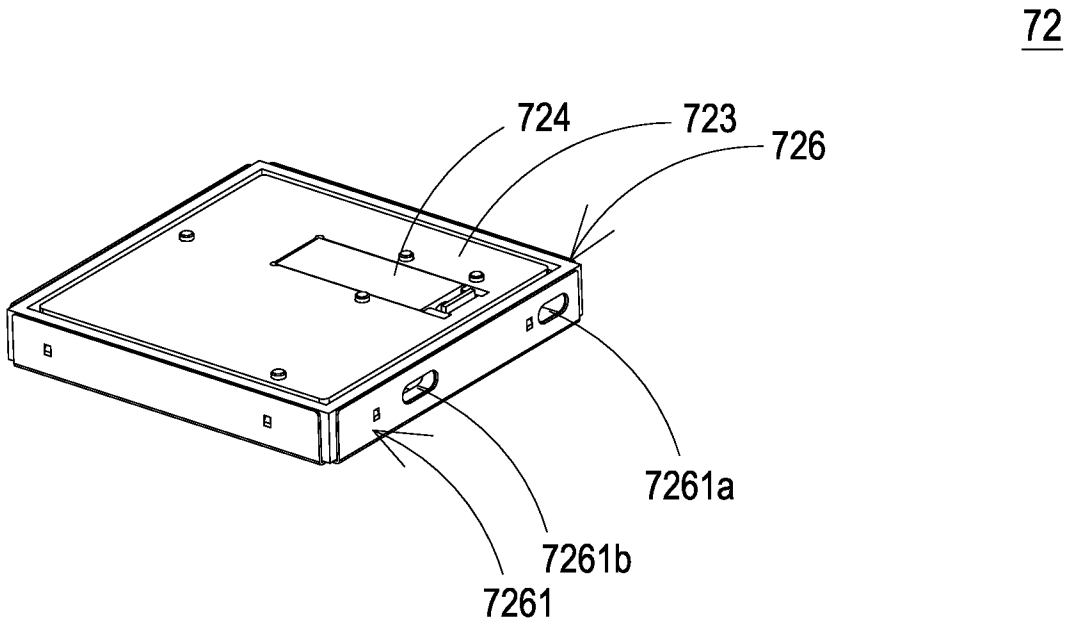
FIG. 5C illustrates a back perspective view of the gas detection main body in the present invention.
Figure 5D:
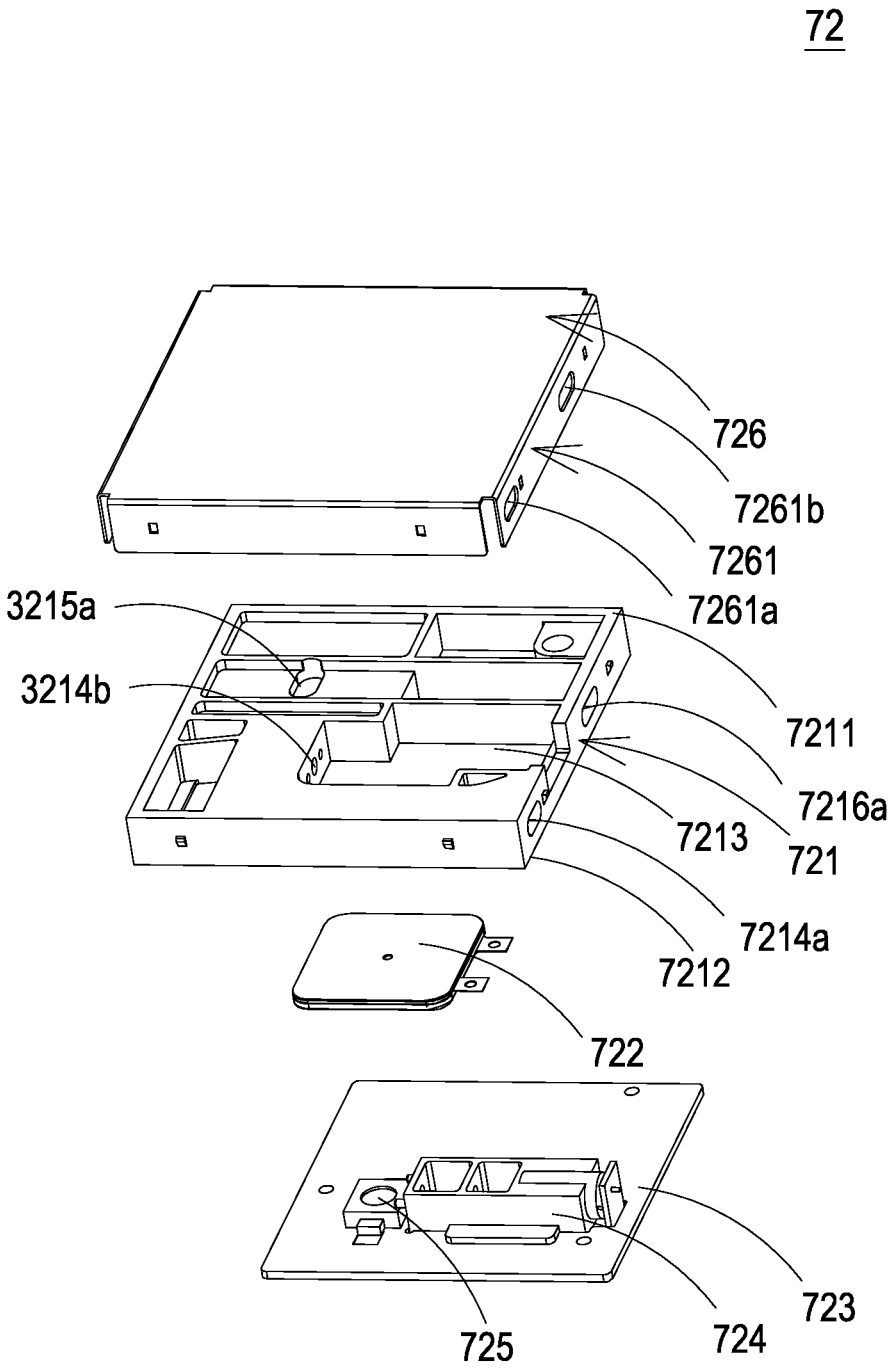
FIG. 5D illustrates an exploded view of the gas detection main body in the present invention.
Figure 6A:
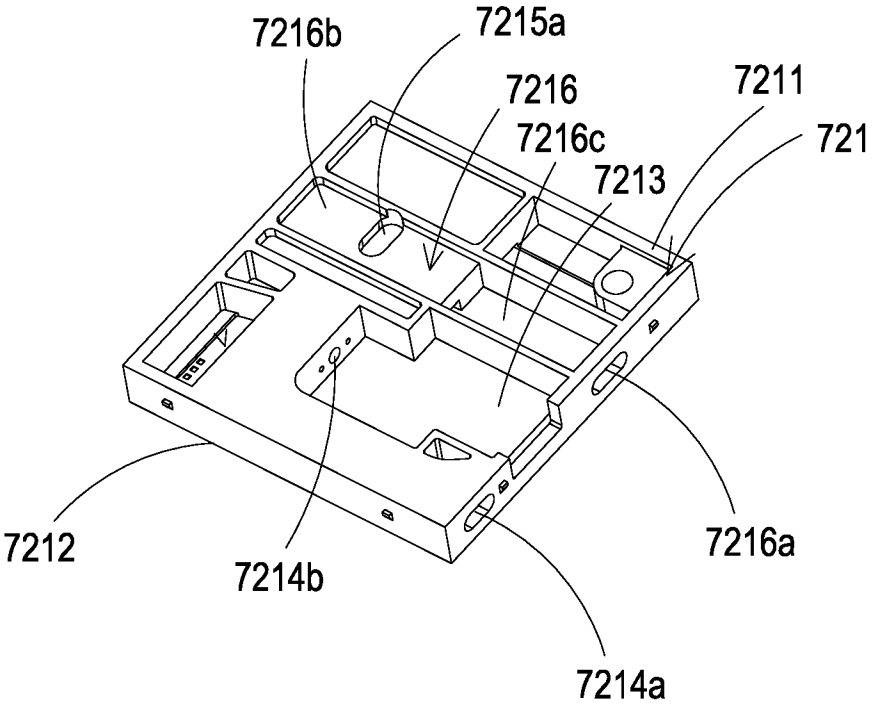
FIG. 6A illustrates a perspective view (1) of a base in the present invention.
Figure 6B:
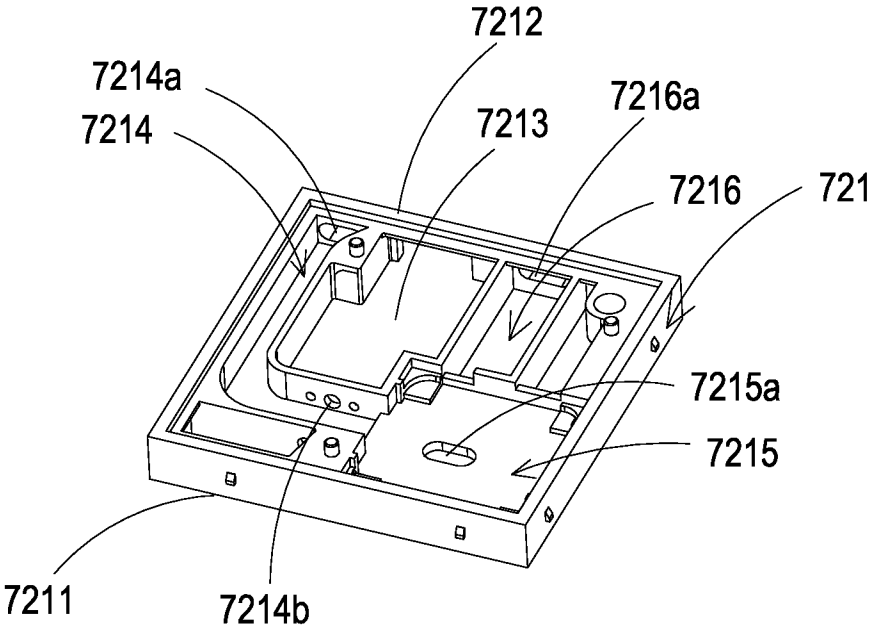
FIG. 6B illustrates a perspective view (2) of the base in the present invention.
Figure 7:
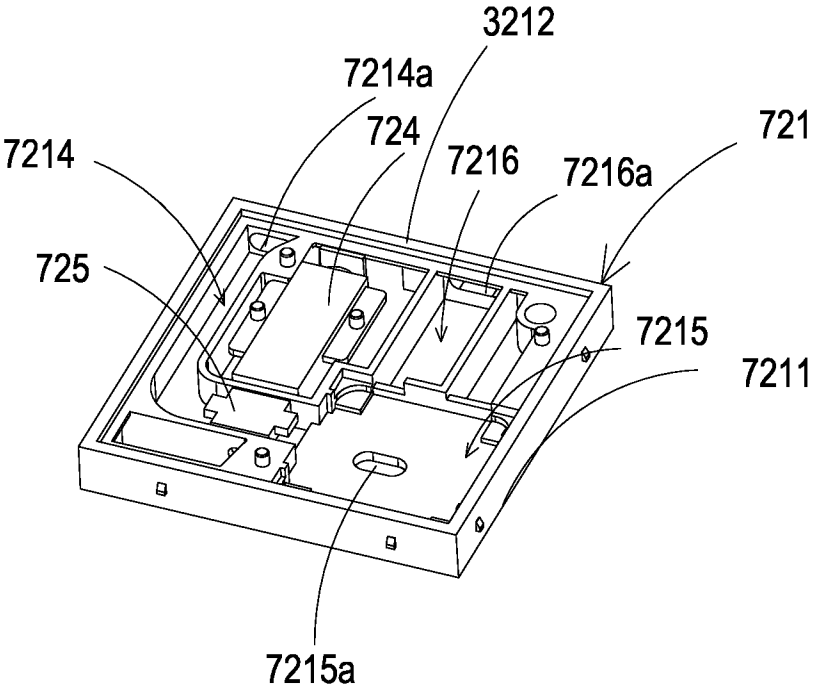
FIG. 7 illustrates a perspective view showing the base assembled with a driving circuit board and a particulate sensor in the present invention.
Figure 8A:
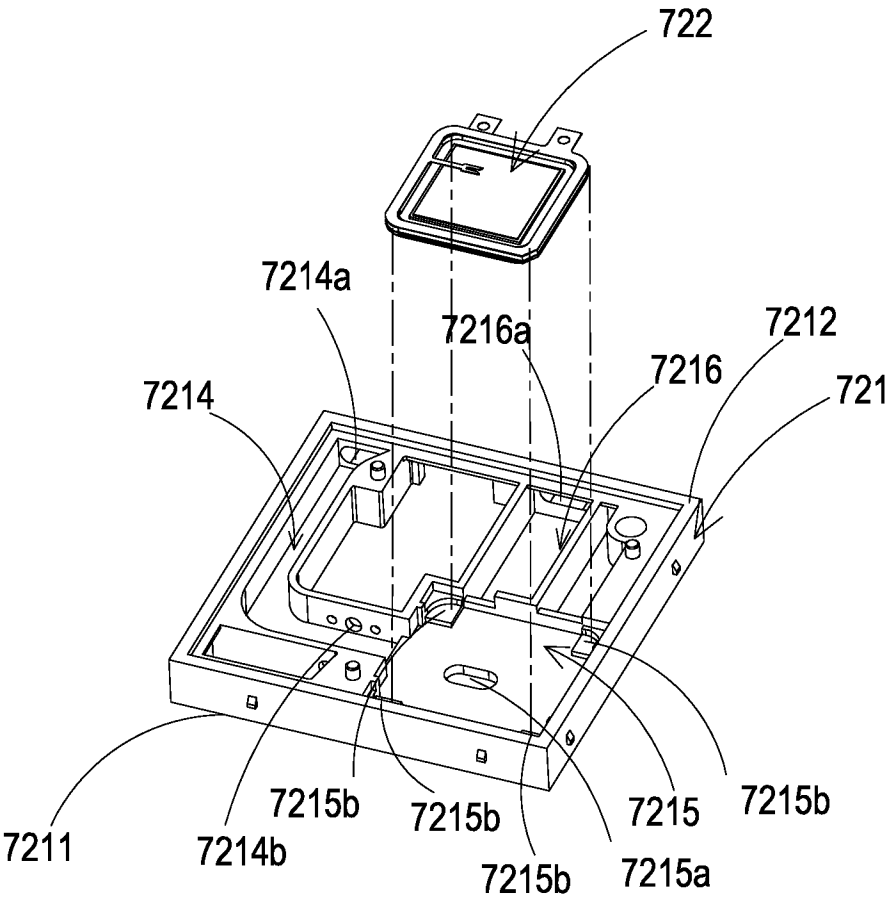
FIG. 8A illustrates an exploded view of a piezoelectric actuator separating from the base in the present invention.
Figure 8B:
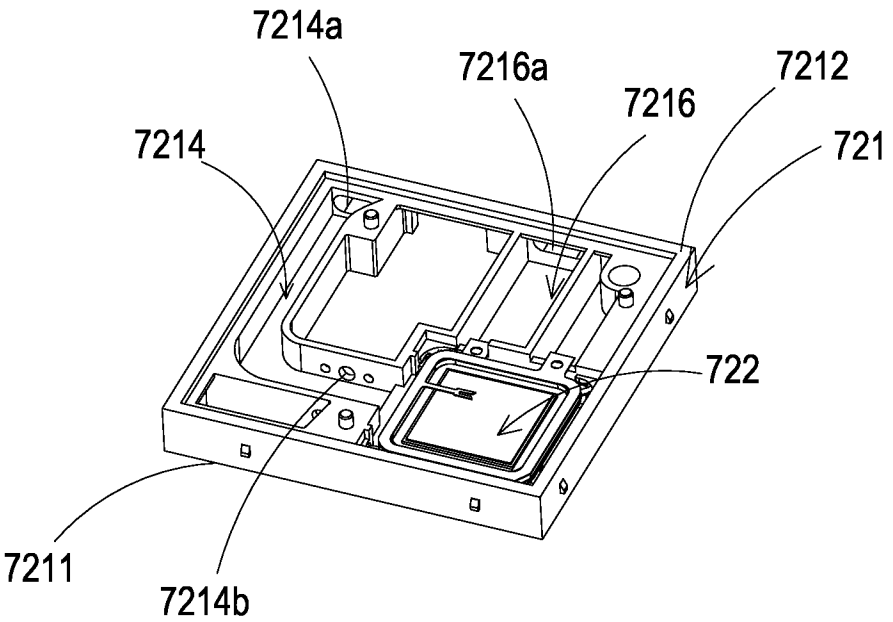
FIG. 8B illustrates a perspective view of the base in combination with the piezoelectric actuator in the present invention.
Figure 9A:
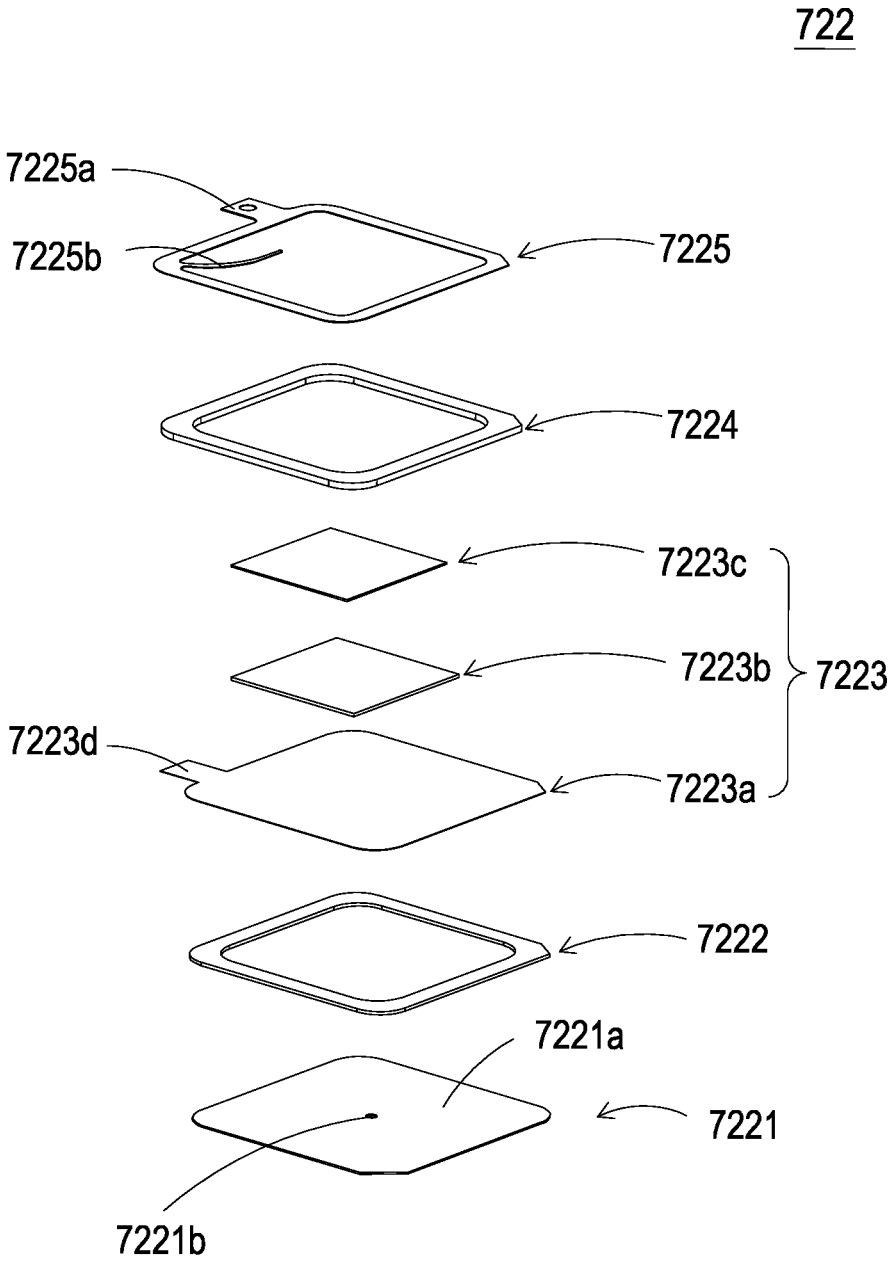
FIG. 9A illustrates a front exploded view of the piezoelectric actuator in the present invention.
Figure 9B:
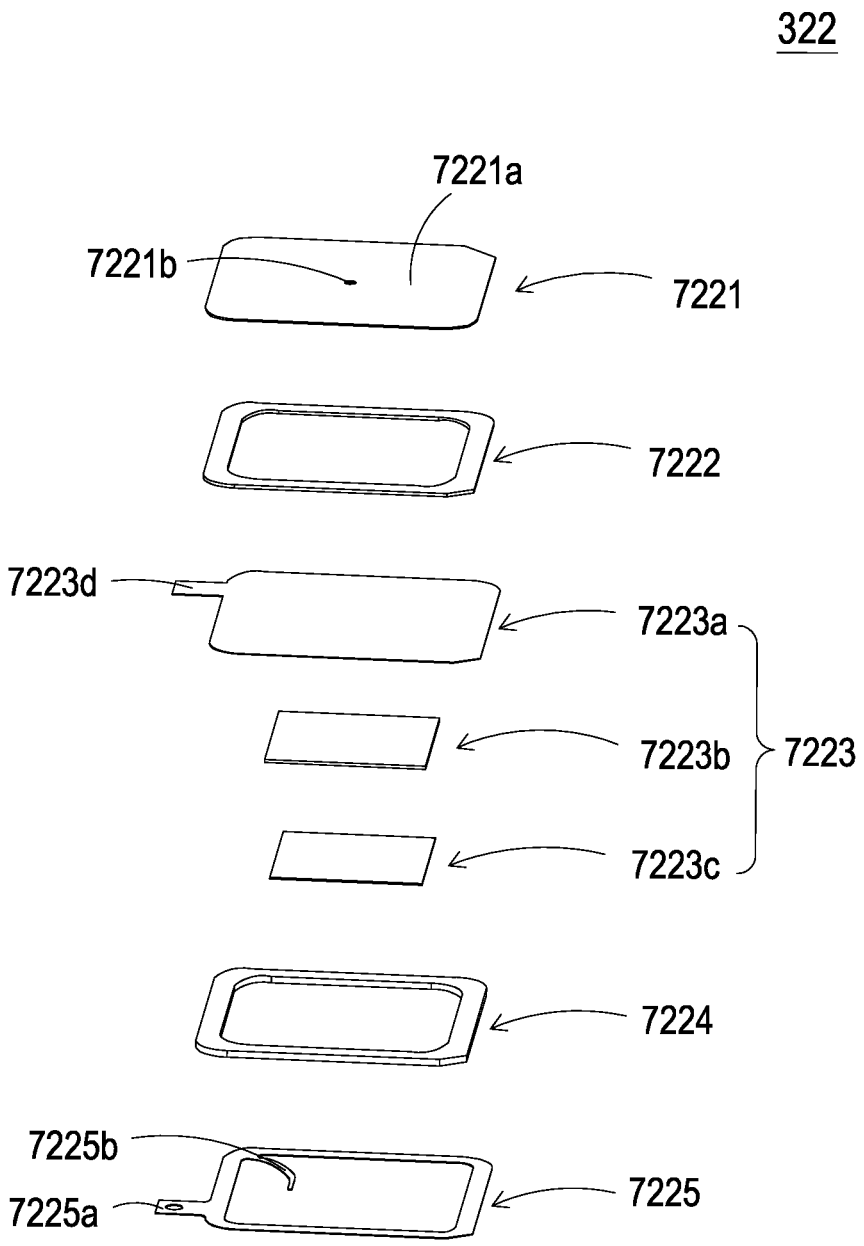
FIG. 9B illustrates a back exploded view of the piezoelectric actuator in the present invention.

Please refer to FIG. 4A and FIG. 4B. The gate 3 includes a holding member 31, a sealing member 32 and a valve plate 33. The holding member 31 includes at least two vents 31*a*, and the valve plate 33 is disposed within an accommodation space 35 formed between the holding member 31 and the sealing member 32. The valve plate 33 includes at least two vents 33*a* corresponding to the at least two vents 31*a* of the holding member 31, respectively. Moreover, the at least two vents 31*a* of the holding member 31 and the at least two vents 33*a* of the valve plate 33 are aligned with each other, respectively. The sealing member 32 includes at least one vent 32*a*. The at least one vent 32*a* of the sealing member 32 is misaligned with the at least two vents 31*a* of the holding member 31. In this embodiment, the valve plate 33 is made of a charged material, and the holding member 31 is made of a bipolar conductive material. The holding member 31 is electrically connected to a control circuit (not shown). The control circuit is controlled by the central processing controller E and is adapted to change electrical polarity (positive polarity or negative polarity) of the holding member 101. In the case that the valve plate 33 is made of a negatively charged material, when the gate 3 is to be opened, the holding member 31 is in positive polarity in response to the control of the control circuit. Since the valve plate 33 and the holding member 31 are charged with opposite polarity, the valve plate 33 moves toward the holding member 31, so that the gate 10 is opened (as shown in FIG. 4B). Alternatively, in the case that the valve plate 33 is made of the negatively charged material, when the gate 3 is to be closed, the holding member 31 is in negative polarity in response to the control of the control circuit. Since the valve plate 33 and the holding member 31 are maintained in the same polarity, the valve plate 33 moves toward the sealing member 32, so that the gate 3 is closed (as shown in FIG. 4A).

The processing channel 2 is in communication with the gas separation channels 4. A coating separation channel 4*a* and a chamber 4*b* are disposed in each of the gas separation channels 4, and the chamber 4*b* is disposed behind the coating separation channel 4*a*, wherein a filling material 4*c* is disposed on an inner wall of the coating separation channel 4*a* by coating or sputtering, therefore the compositions of compounds contained in the gas introduced into the processing channel 2 by the MEMS pump 1 can be absorbed and separated, and the compositions of compounds with different flow rates are introduced into different coating separation channels 4*a* and flow into the chambers 4*b* respectively connected to the coating separation channels 4*a*. For each of the chambers 4*b*, two of the gates 3 are disposed at two ends of the chamber 4*b*, and a gas detector 6 is disposed in the chamber 4*b*. The gas detector 6 is configured to detect a concentration and a property of each of the compositions of compounds contained in the introduced gas and to control the gates 3 at the two ends of the chamber 4*b* to be opened or closed. The compositions of compounds are introduced into the chamber 4*b*, and a gas conversion processing mechanism is further performed. The central processing controller E controls the gates 3 at the two ends of the chamber 4*b* to be closed, and the compositions of compounds contained in the introduced gas are processed through a physical type or a chemical type conversion device (for example, the chemical conversion layer 4D or the physical conversion layer 4E shown in FIG. 2A) to allow the indoor air pollution data or the outdoor air pollution data to be detected by the gas detector 6 to have a safety detection value, and a detection result is transmitted to the central processing controller E to control the gates 3 at the two ends of the chamber 4*b* to be opened.

It should be noted that, the gas conversion processing mechanism is performed by disposing a conversion device in the chamber 4*b*. In some embodiments, the conversion device may be the chemical conversion layer 4D coated on the chamber 4*b*, as shown in FIG. 2A. For example, the chemical conversion layer 4D may be an herbal protection degradation layer including the extracts of *Rhus chinensis* Mill (may be *Rhus chinensis* Mill from Japan) and the extracts of *Ginkgo biloba* to efficiently perform anti-allergy function and destroy cell surface proteins of influenza viruses (e.g., influenza virus subtype H1N1). For example, the chemical conversion layer 4D may be a degradation layer of silver ions for suppressing viruses, bacteria, and fungus in the compositions of compounds contained in the introduced gas. For example, the chemical conversion layer 4D may be a zeolite degradation layer for removing ammonia, heavy metals, organic pollutants, *Escherichia coli*, phenol, chloroform, or anion surfactants. In some embodiments, the conversion device may be the physical conversion layer 4E deposited on the chamber 4*b*, as shown in FIG. 2A. For example, the physical conversion layer 4E may be a photocatalyst such as a nanometer light tube or a UV light tube. When the photocatalyst is illuminated by a light, the light energy is converted into electrical energy so as to degrade the hazardous matters in the introduced gas. Therefore, the compositions of compounds contained in the introduced gas are processed through the physical type or the chemical type conversion device (for example, the chemical conversion layer 4D or the physical conversion layer 4E shown in FIG. 2A) to allow the indoor air pollution data or the outdoor air pollution data to be detected by the gas detector 6 to have a safety detection value, and a detection result is transmitted to the central processing controller E to control the gates 3 at the two ends of the chamber 4*b* to be opened, so that the gas is introduced into the indoor space ID.

It is noted that, in some embodiments, the gas detector 6 is a volatile organic compound detector capable of detecting information of carbon dioxide or total volatile organic compounds; in some embodiments, the gas detector 6 is a formaldehyde sensor capable of detecting information of formaldehyde (HCHO) gas; in some embodiments, the gas detector 6 is a bacterial sensor is capable of detecting information of bacteria or fungi; in some embodiments, the gas detector 6 is a virus sensor is capable of detecting information of viruses.

It is worth to note that, the safety detection value includes at least one selected from the group consisting of a concentration of carbon dioxide which is less than 1000 ppm, a concentration of total volatile organic compounds which is less than 0.56 ppm, a concentration of formaldehyde which is less than 0.08 ppm, a colony-forming unit per cubic meter of bacteria which is less than 1500 CFU/$m^3$, a colony-forming unit per cubic meter of fungi which is less than 1000 CFU/$m^3$, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, a concentration of lead which is less than 0.15 μg/$m^3$, and any combination thereof.

As mentioned above, in some embodiments, as shown in FIG. 2B, the gas exchange device C is manufactured by a plurality of gas-guiding units 10, and the gas-guiding units 10 are integrated as a thin member through semiconductor manufacturing processes, wherein the gas exchange device C is configured between the outdoor space OD and the indoor space ID. The filtering component D is disposed at a gas-guiding end of the gas exchange device C, so that the outdoor gas is cleaned and enters the indoor space ID. Therefore, an electronic- and micro-air exchange system can be built up. The assembling cost for the system is low, and the system does not occupy a large space in the indoor space ID. Moreover, with at least one outdoor air pollution detector A and a plurality of indoor air pollution detectors B, the outdoor air pollution data and the indoor air pollution data are transmitted to the central processing controller E. The central processing controller E performs an intelligent computation so as to control the gas exchange device C to be opened or closed and to determine whether the outdoor gas is to be introduced into the indoor space ID or the indoor gas is to be discharged to the outdoor space OD, so that the indoor gas in the indoor space is exchanged and cleaned to a safe and breathable state.

It is noted that, in some embodiments, the filtering component D is a high-efficiency particulate air (HEPA) filter. Alternatively, in some embodiments, the filtering component D is a filter having a minimum efficiency reporting value (MERV) 13 or higher.

In some embodiments, each of the outdoor air pollution detector A and the indoor air pollution detectors B is an air pollution detector 7. To illustrate the embodiments of the present invention clearly, the detail structures of the air pollution detector 7 are illustrated as below.

Please refer to FIG. 5A to FIG. 12. The air pollution detector 7 includes a control circuit board 71, a gas detection main body 72, a microprocessor 73, and a communication device 74. The gas detection main body 72, the microprocessor 73, and the communication device 74 are integrally packaged with the control circuit board 71 and electrically connected to each other. The microprocessor 73 controls the gas detection main body 72 to enable the operation of the gas detection main body 72, thus the gas detection main body 72 detects the air pollution and outputs a detection signal, and the microprocessor 73 receives the detection signal so as to compute, process, and output the air pollution data, therefore the microprocessor 73 provides the communication device 74 with the air pollution data for wirelessly transmitting outwardly to the central processing controller E. The wireless communication is implemented by a Wi-Fi module, a Bluetooth module, a radiofrequency identification (RFID) module, or a near field communication (NFC) module.

Please refer to FIG. 5A to FIG. 10A. In one or some embodiments, the gas detection main body 72 includes a base 721, a piezoelectric actuator 722, a driving circuit board 723, a laser component 724, a particulate sensor 725, and an outer cover 726. The base 721 has a first surface 7211, a second surface 7212, a laser installation region 7213, a gas inlet groove 7214, a gas-guiding component installation region 7215, and a gas outlet groove 7216. The first surface 7211 and the second surface 7212 are opposite to each other. The laser installation region 7213 is formed by hollowing out the base 721 from the first surface 7211 to the second surface 7212 for accommodating the laser component 724. The outer cover 726 covers the base 721 and has a side plate 7261. The side plate 7261 has a gas inlet opening 7261*a* and a gas outlet opening 7261*b*. The gas inlet groove 7214 is recessed from the second surface 7212 and adjacent to the laser installation region 7213. The gas inlet groove 7214 has a gas inlet through hole 7214*a* and two lateral walls. The gas inlet through hole 7214*a* is in communication with the outside environment of the base 721 and is corresponding to the gas inlet opening 7261*a* of the outer cover 726. Two light penetration windows 7214*b* penetrate the two lateral walls of the gas inlet groove 7214 and are in communication with the laser installation region 7213. Therefore, when the first surface 7211 of the base 721 is covered by the outer cover 726, and the second surface 7212 of the base 721 is covered by the driving circuit board 723, a gas inlet path can be defined by the gas inlet groove 7214.

The gas-guiding component installation region 7215 is recessed from the second surface 7212 and in communication with the gas inlet groove 7214. A vent 7215*a* penetrates a bottom surface of the gas-guiding component installation region 7215. Each of the four corners of the gas-guiding component installation region 7215 has a positioning bump 7215*b*. The gas outlet groove 7216 has a gas outlet through hole 7216*a*, and the gas outlet through hole 7216*a* is corresponding to the gas outlet opening 7261*b* of the outer cover 726. The gas outlet groove 7216 includes a first region 7216*b* and a second region 7216*c*. The first region 7216*b* is recessed from a portion of the first surface 7211 corresponding to a vertical projection region of the gas-guiding component installation region 7215. The second region 7216*c* is at a portion extending from a region that is not corresponding to the vertical projection region of the gas-guiding component installation region 7215, and the second region 7216*c* is hollowed out from the first surface 7211 to the second surface 7212. The first region 7216*b* is connected to the second region 7216*c* to form a stepped structure. Moreover, the first region 7216*b* of the gas outlet groove 7216 is in communication with the vent 7215*a* of the gas-guiding component installation region 7215, and the second region 7216*c* of the gas outlet groove 7216 is in communication with the gas outlet through hole 7216*a*. Therefore, when the first surface 7211 of the base 721 is covered by the outer cover 726 and the second surface 7212 of the base 721 is covered by the driving circuit board 723, a gas outlet path can be defined by the gas outlet groove 7216 and the driving circuit board 723.

Furthermore, the laser component 724 and the particulate sensor 725 are disposed on the driving circuit board 723 and located in the base 721. It should notice that, the driving circuit board 723 is omitted to clearly explain the positions of the laser component 724, the particulate sensor 725, and the base 721. In the embodiment of the present invention, the laser component 724 is located at the laser installation region 7213 of the base 721. The particulate sensor 725 is located at the gas inlet groove 7214 of the base 721 and aligned with the laser component 724. Moreover, the laser component 724 is corresponding to the light penetration windows 7214*b* in order to allow the light beam emitted by the laser component 724 to pass therethrough and into the gas inlet groove 7214. The light path of the light beam emitted by the laser component 724 passes through the light penetration windows 7214*b* and is orthogonal to the gas inlet groove 7214. The light beam emitted by the laser component 724 passes into the gas inlet groove 7214 through the light penetration windows 7214*b*, thereby the particulate matters in the gas inlet groove 7214 is illuminated by the light beam. When the light beam contacts the gas, the light beam will be scattered and generate light spots. Hence, the light spots generated by the scattering are received and calculated by the particulate sensor 725 located at the position orthogonal to the gas inlet groove 7214 to obtain the detection data of the gas.

Moreover, the piezoelectric actuator 722 is located at the square-shaped gas-guiding component installation region 7215 of the base 721, and the gas-guiding component installation region 7215 is in communication with the gas inlet groove 7214. When the piezoelectric actuator 722 is enabled, the gas in the gas inlet groove 7214 is inhaled into the piezoelectric actuator 722, passing through the vent 7215*a* of the gas-guiding component installation region 7215, and entering the gas outlet groove 7216. Moreover, the driving circuit board 723 covers the second surface 7212 of the base 721. The laser component 724 and the particulate sensor 725 are disposed on the driving circuit board 723 and electrically connected to the driving circuit board 723. As the outer cover 726 covers the base 721, the gas inlet opening 7261*a* is corresponding to the gas inlet through hole 7214*a* of the base 721, and the gas outlet opening 7216*b* is corresponding to the gas outlet through hole 7216*a* of the base 721.

Furthermore, the piezoelectric actuator 722 includes a nozzle plate 7221, a chamber frame 7222, an actuation body 7223, an insulation frame 7224, and a conductive frame 7225. The nozzle plate 7221 is made by a flexible material and has a suspension sheet 7221*a* and a hollow hole 7221*b*. The suspension sheet 7221*a* is a flexible sheet which can bend and vibrate. The shape and the size of the suspension sheet 7221*a* approximately corresponding to the inner edge of the gas-guiding component installation region 7215. The hollow hole 7221*b* penetrates through the center portion of the suspension sheet 7221*a* for the gas flowing therethrough. In one embodiment of the present invention, the shape of the suspension sheet 7221*a* can be selected from square, circle, ellipse, triangle, or polygon.

Furthermore, the chamber frame 7222 is stacked on the nozzle plate 7221, and the shape of the chamber frame 7222 is corresponding to the shape of the nozzle plate 7221. The actuation body 7223 is stacked on the chamber frame 7222. A resonance chamber 7226 is collectively defined between the actuation body 7223, the chamber frame 7222, and the suspension sheet 7221*a*. The insulation frame 7224 is stacked on the actuation body 7223. The appearance of the insulation frame 7224 is similar to the appearance of the chamber frame 7222. The conductive frame 7225 is stacked on the insulation frame 7224. The appearance of the conductive frame 7225 is similar to the appearance of the insulation frame 7224. The conductive frame 7225 has a conductive pin 7225*a* and a conductive electrode 7225*b*. The conductive pin 7225*a* extends outwardly from the outer edge of the conductive frame 7225, and the conductive electrode 7225*b* extends inwardly from the inner edge of the conductive frame 7225. Moreover, the actuation body 7223 further includes a piezoelectric carrying plate 7223*a*, an adjusting resonance plate 7223*b*, and a piezoelectric plate 7223*c*. The piezoelectric carrying plate 7223*a* is stacked on the chamber frame 7222, and the adjusting resonance plate 7223*b* is stacked on the piezoelectric carrying plate 7223*a*. The piezoelectric plate 7223*c* is stacked on the adjusting resonance plate 7223*b*. The adjusting resonance plate 7223*b* and the piezoelectric plate 7223*c* are accommodated in the insulation frame 7224. The conductive electrode 7225*b* of the conductive frame 7225 is electrically connected to the piezoelectric plate 7223*c*. In one preferred embodiment of the present invention, the piezoelectric carrying plate 7223*a* and the adjusting resonance plate 7223*b* are both made of conductive material(s). The piezoelectric carrying plate 7223*a* has a piezoelectric pin 7223*d*. The piezoelectric pin 7223*d* and the conductive pin 7225*a* are in electrical connection with a driving circuit (not shown) of the driving circuit board 723 to receive a driving signal (which may be a driving frequency and a driving voltage). The piezoelectric pin 7223*d*, the piezoelectric carrying plate 7223*a*, the adjusting resonance plate 7223*b*, the piezoelectric plate 7223*c*, the conductive electrode 7225*b*, the conductive frame 7225, and the conductive pin 7225*a* may together generate an electrical circuit for transmitting the driving signal, and the insulation frame 7224 is provided for electrically insulating the conductive frame 7225 from the actuation body 7223 to avoid short circuit, thereby the driving signal can be transmitted to the piezoelectric plate 7223*c*. When the piezoelectric plate 7223*c* receives the driving signal, the piezoelectric plate 7223*c* deforms owing to the piezoelectric effect, and thus the piezoelectric carrying plate 7223*a* and the adjusting resonance plate 7223*b* are driven to vibrate in a reciprocating manner.

Moreover, the adjusting resonance plate 7223*b* is disposed between the piezoelectric plate 7223*c* and the piezoelectric carrying plate 7223*a* as a cushion element so as to adjust the vibration frequency of the piezoelectric carrying plate 7223*a*. Generally, the thickness of the adjusting resonance plate 7223*b* is greater than the thickness of the piezoelectric carrying plate 7223*a*. The thickness of the adjusting resonance plate 7223*b* may be modified to adjust the vibration frequency of the actuation body 7223.

Please refer to FIG. 8A, FIG. 8B, FIG. 9A, FIG. 9B, and FIG. 10A. The nozzle plate 7221, the chamber frame 7222, the actuation body 7223, the insulation frame 7224, and the conductive frame 7225 are sequentially stacked and assembled and are positioned in the gas-guiding component installation region 7215, thereby a clearance 7221*c* is defined between the suspension sheet 7221*a* and the inner edge of the gas-guiding component installation region 7215 for the gas to pass therethrough. A gas flow chamber 7227 is formed between the nozzle plate 7221 and the bottom surface of the gas-guiding component installation region 7215. The gas flow chamber 7227 is in communication with the resonance chamber 7226 formed between the actuation body 7223, the chamber frame 7222, and the suspension sheet 7221*a* through the hollow hole 7221*b* of the nozzle plate 7221. In one aspect of the present invention, the resonance chamber 7226 and the suspension sheet 7221*a* can generate the Helmholtz resonance effect to improve the transmission efficiency of the gas through controlling the vibration frequency of the gas in the resonance chamber 7226 to be close to the vibration frequency of the suspension sheet 7221*a*. When the piezoelectric plate 7223*c* moves in a direction away from the bottom surface of the gas-guiding component installation region 7215, the piezoelectric plate 7223*c* drives the suspension sheet 7221*a* of the nozzle plate 7221 to move in the direction away from the bottom surface of the gas-guiding component installation region 7215 correspondingly. Hence, the volume of the gas flow chamber 7227 expands dramatically, therefore the internal pressure of the gas flow chamber 7227 decreases and creates a negative pressure, drawing the gas outside the piezoelectric actuator 722 to flow into the piezoelectric actuator 722 through the clearance 7221*c* and enter the resonance chamber 7226 through the hollow hole 7221*b*, thereby increasing the gas pressure of the resonance chamber 7226 and thus generating a pressure gradient. When the piezoelectric plate 7223*c* drives the suspension sheet 7221*a* of the nozzle plate 7221 to move toward the bottom surface of the gas-guiding component installation region 7215, the gas inside the resonance chamber 7226 is pushed to flow out quickly through the hollow hole 7221*b* to further push the gas inside the gas flow chamber 7227, thereby the converged gas can be quickly and massively ejected out of the gas flow chamber 7227 through the vent 7215*a* of the gas-guiding component installation region 7215 in a state closing to an ideal gas state under the Bernoulli's law.

Figure 10A:
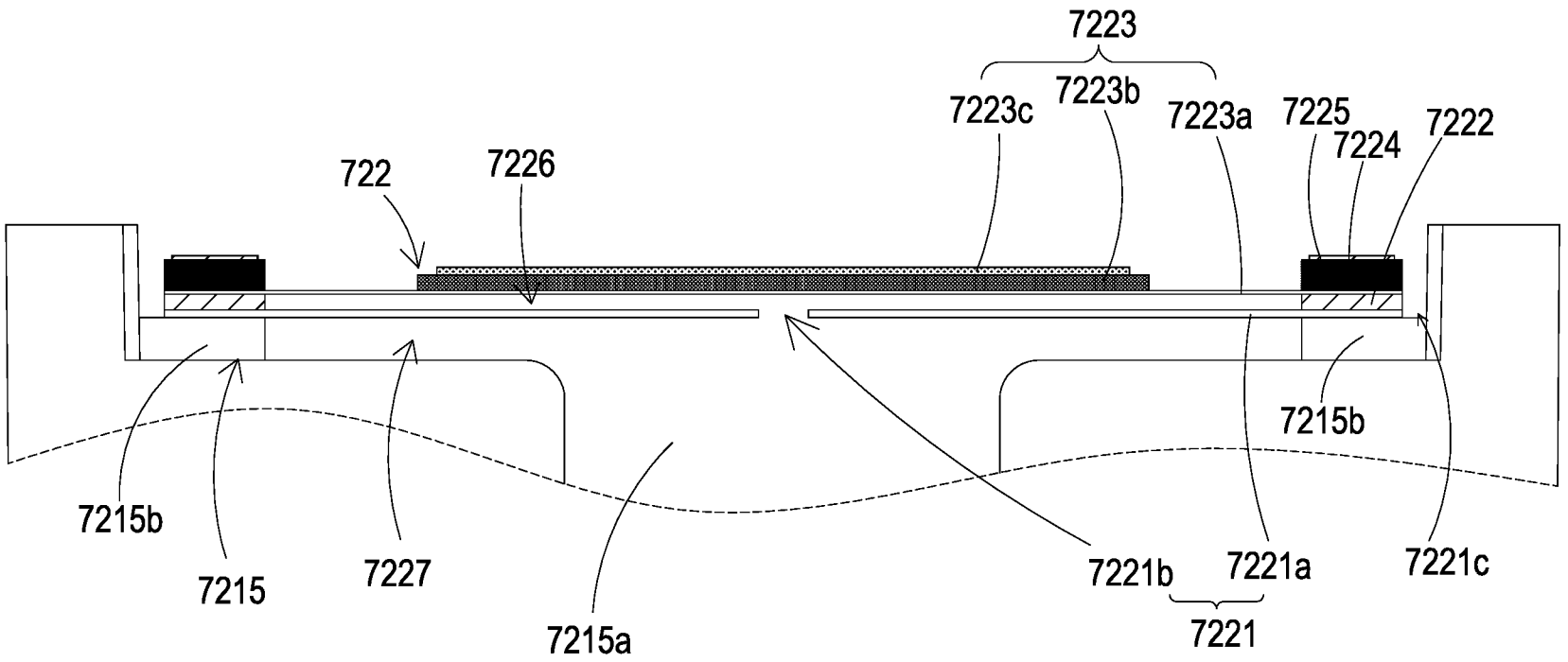
FIG. 10A illustrates a cross-sectional view of the piezoelectric actuator in the present invention.
Figure 10B:
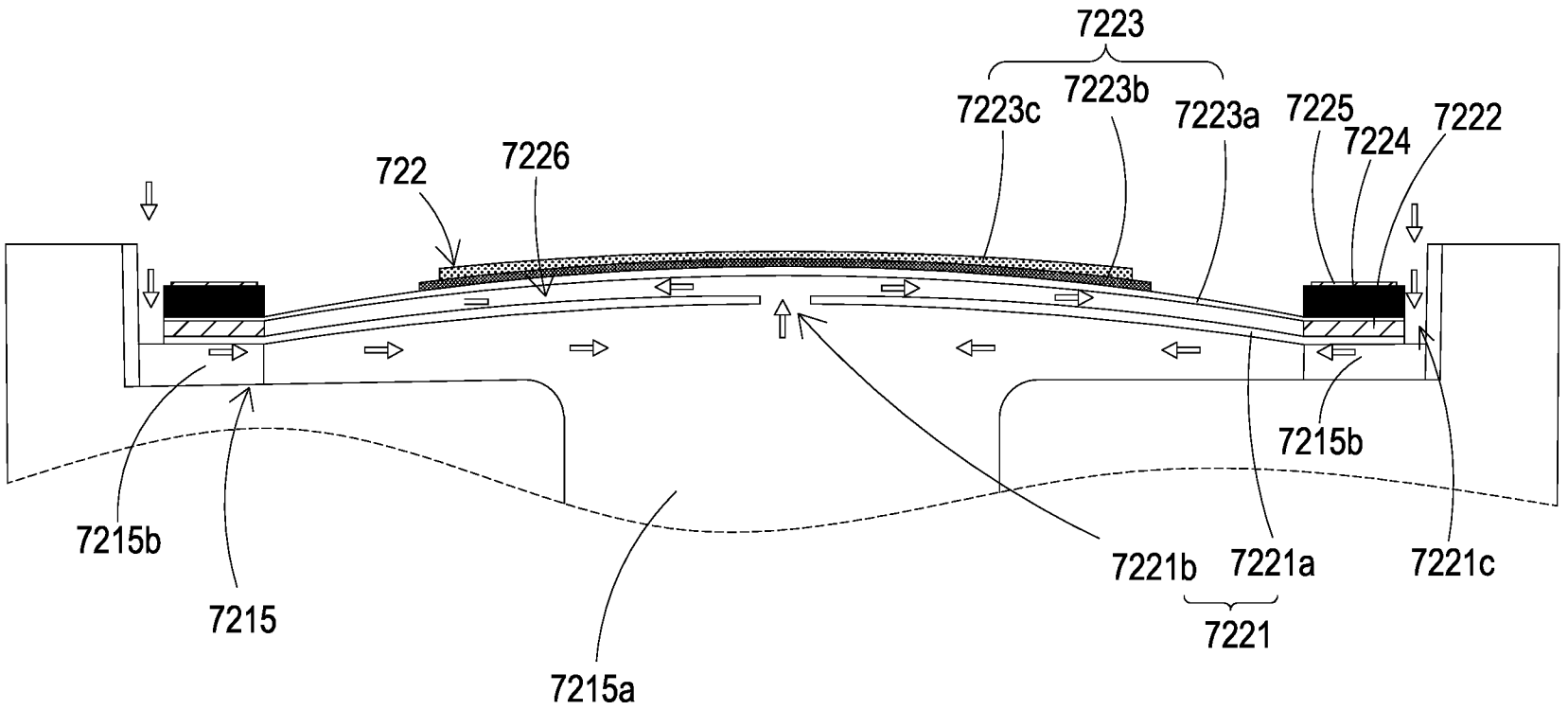
FIG. 10B and FIG. 10C illustrate cross-sectional views showing the operations of the piezoelectric actuator in the present invention.
Figure 10C:
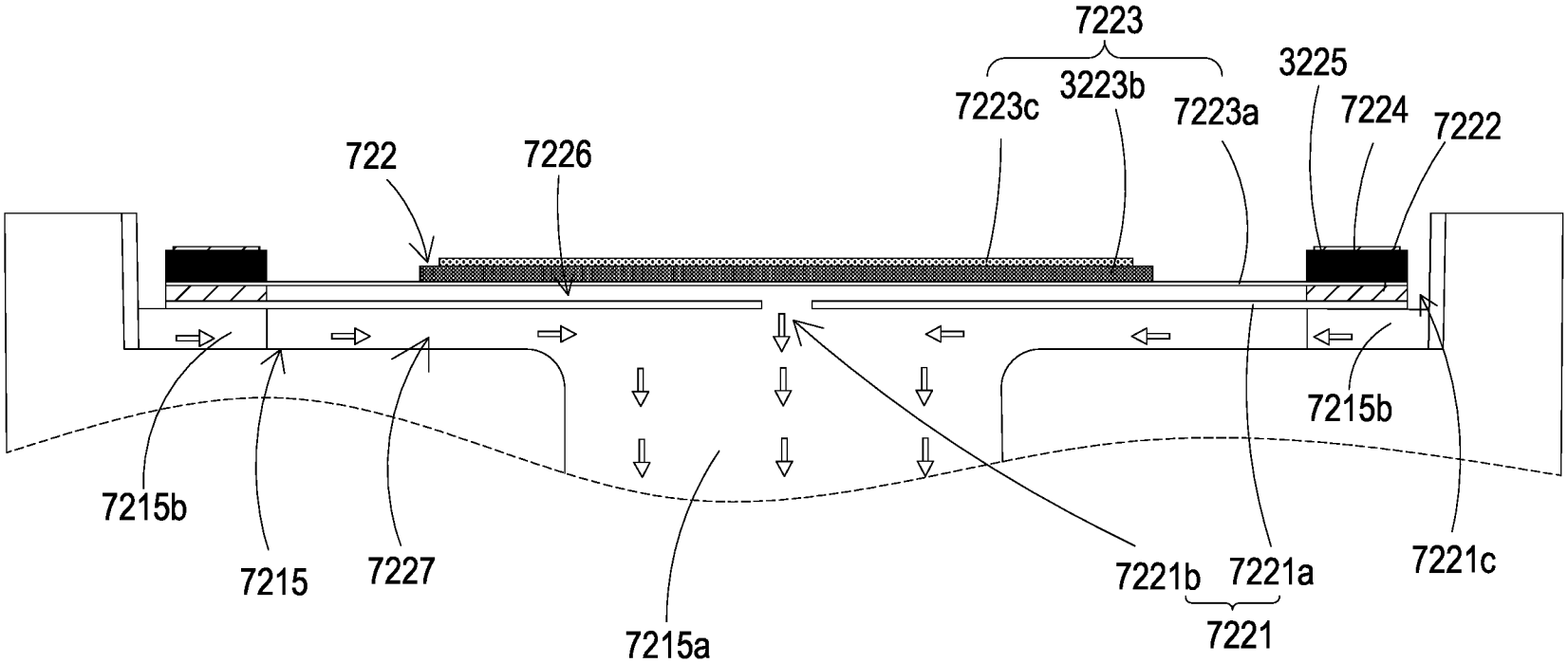
Figure 11A:
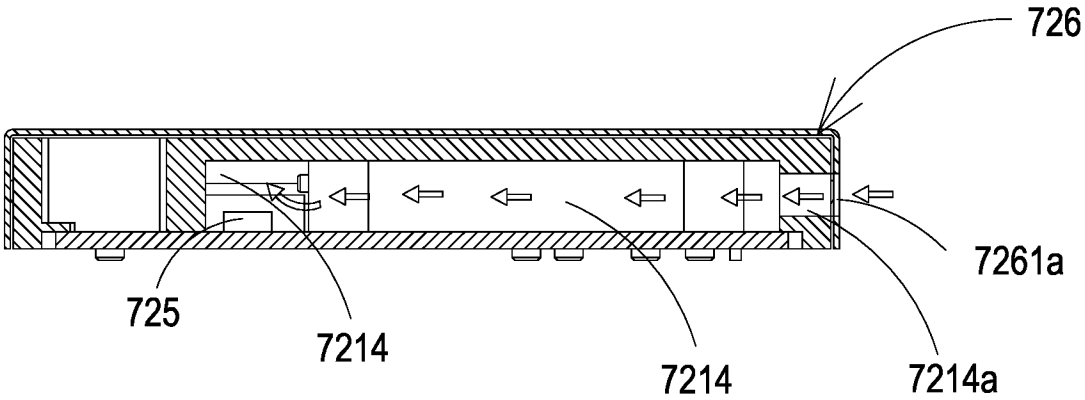
FIG. 11A illustrates a cross-sectional view (1) of the gas detection main body in the present invention.
Figure 11B:
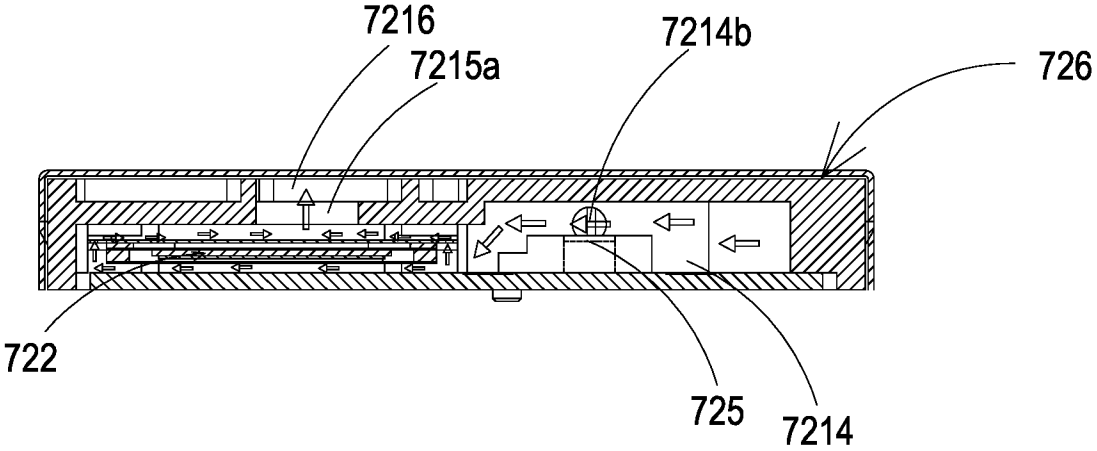
FIG. 11B illustrates a cross-sectional view (2) of the gas detection main body in the present invention.
Figure 11C:
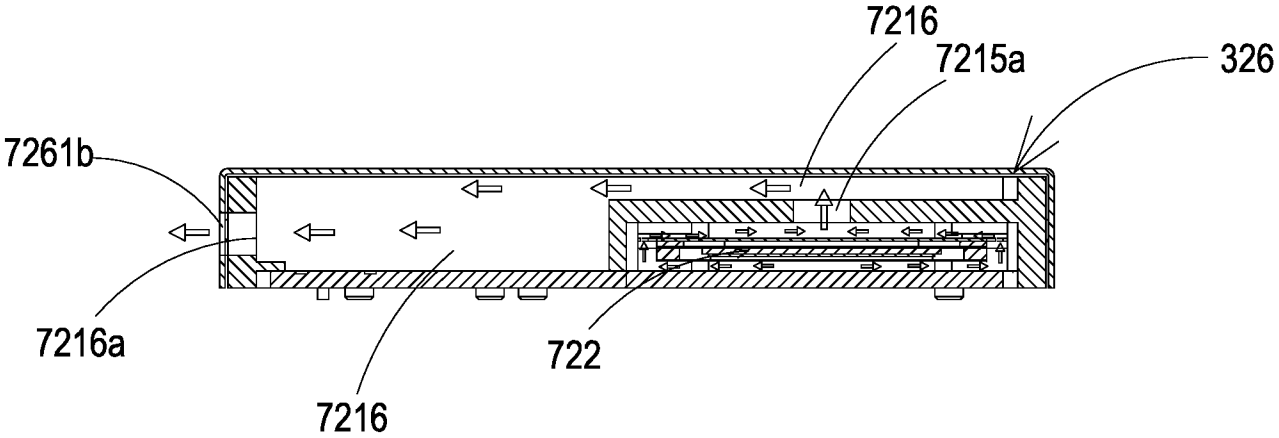
FIG. 11C illustrates a cross-sectional view (3) of the gas detection main body in the present invention.
Figure 12:
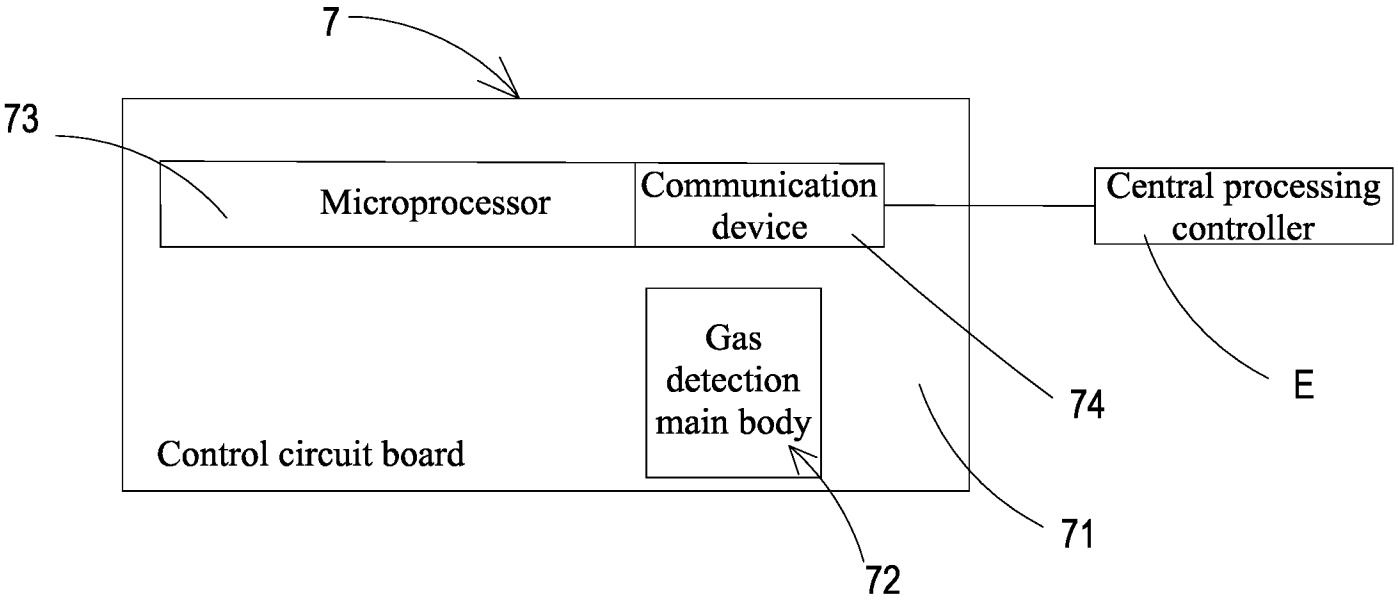
FIG. 12 illustrates a schematic view showing the transmission of the air pollution detector in the present invention.

Therefore, through repeating the steps as shown in FIG. 10B and FIG. 10C, the piezoelectric plate 7223*c* can bend and vibrate in a reciprocating manner. Further, after the gas is discharged out of the resonance chamber 7226, the internal pressure of the resonance chamber 7226 is lower than the equilibrium pressure due to the inertia, as a result, the pressure difference guides the gas outside the resonance chamber 7226 into the resonance chamber 7226 again. Therefore, through controlling the vibration frequency of the gas in the resonance chamber 7226 to be close to the vibration frequency of the piezoelectric plate 7223*c*, the resonance chamber 7226 and the piezoelectric plate 7223*c* can generate the Helmholtz resonance effect so as to achieve effective, high-speed, and large-volume gas transmission of the gas. Moreover, the gas enters the gas detection main body 72 from the gas inlet opening 7261*a* of the outer cover 726, flows into the gas inlet groove 7214 of the base 721 through the gas inlet through hole 7214*a*, and reaches the position of the particulate sensor 725. Furthermore, the piezoelectric actuator 722 continuously drives the gas into the gas inlet path so as to facilitate the gas inside the gas detection main body 72 to stably and quickly pass through the particulate sensor 725. Next, the light beam emitted by the laser component 724 passes through the light penetration windows 7214*b*, enters the gas inlet groove 7214, and illuminates the gas in the gas inlet groove 7214 which passes through the particulate sensor 725. When the light beam from the particulate sensor 725 illuminates on the particulate matters in the gas, the light beam will be scattered and generate light spots. The particulate sensor 725 receives and calculates the light spots generated by the scattering to obtain the information of the particulate matters in the gas such as the particle size and the number of the particulate matters. Moreover, the gas passing through the particulate sensor 725 is continuously introduced into the vent 7215*a* of the gas-guiding component installation region 7215 by the piezoelectric actuator 722 and enters the gas outlet groove 7216. Finally, after the gas enters the gas outlet groove 7216, since the piezoelectric actuator 722 continuously delivers the gas into gas outlet groove 7216, therefore the gas is continuously pushed and discharged out of the gas detection main body 72 through the gas outlet through hole 7216*a* and the gas outlet opening 7261*b*.

According to one or some embodiments of the present invention, an indoor gas exchange system is provided. In the indoor gas exchange system, a gas exchange device is manufactured by a plurality of gas-guiding units. The gas-guiding units are integrated as a thin member through semiconductor manufacturing processes. The gas exchange device is configured between the outdoor space and the indoor space to provide gas exchange for the indoor space and the outdoor space. Moreover, with at least one outdoor air pollution detector and a plurality of indoor air pollution detectors, outdoor air pollution data and indoor air pollution data are transmitted to a central processing controller. The central processing controller performs an intelligent computation to control the gas exchange device to be opened or closed and to determine whether the outdoor gas is to be introduced into the indoor space or the indoor gas is to be discharged to the outdoor space, so that the indoor gas in the indoor space is exchanged and cleaned to a safe and breathable state.

The foregoing outlines features of several embodiments so that those skilled in the art may better understand the aspects of the present invention. Those skilled in the art should appreciate that they may readily use the present invention as a basis for designing or modifying other processes and structures for carrying out the same purposes and/or achieving the same advantages of the embodiments introduced herein. Those skilled in the art should also realize that such equivalent constructions do not depart from the spirit and scope of the present invention, and that they may make various changes, substitutions, and alterations herein without departing from the spirit and scope of the present invention.

What is claimed is:

1. An indoor gas exchange system configured between an outdoor space and an indoor space, wherein the indoor gas exchange system comprises:

at least one outdoor air pollution detector disposed in the outdoor space and configured to detect a qualitative property and a concentration of an air pollution of an outdoor gas and output an outdoor air pollution data;

a plurality of indoor air pollution detectors disposed in the indoor space and configured to detect a qualitative property and a concentration of an air pollution of an indoor gas and output an indoor air pollution data;

a gas exchange device formed by a plurality of gas-guiding units which are integrated as a thin member through semiconductor manufacturing processes, wherein the gas exchange device is configured between the outdoor space and the indoor space to provide gas exchange for the indoor gas and the outdoor gas, wherein each of the gas-guiding units comprises a plurality of pumps, a processing channel, a plurality of gates, a plurality of gas separation channels, and a ventilation channel;

a filtering component disposed at a gas-guiding end of the gas exchange device, so that the outdoor gas is cleaned and enters the indoor space; and a central processing controller, wherein the central processing controller is configured to receive the outdoor air pollution data and the indoor air pollution data, performing an intelligent computation to control the gas exchange device to be opened or closed, and determine whether the outdoor gas is to be introduced into the indoor space or the indoor gas is to be discharged to the outdoor space, so that the indoor gas in the indoor space is exchanged and cleaned to a safe and breathable state.

2. The indoor gas exchange system according to claim 1, wherein the air pollution comprises at least one selected from the group consisting of particulate matters, carbon monoxide, carbon dioxide, ozone, sulfur dioxide, nitrogen dioxide, lead, total volatile organic compounds, formaldehyde, bacteria, fungi, viruses, and any combination thereof.

3. The indoor gas exchange system according to claim 1, wherein one of the pumps and one of the gates are disposed in the processing channel, the pump guides the outdoor gas in the outdoor space to be introduced into the processing channel, and the central processing controller receives the outdoor air pollution data and the indoor air pollution data to perform the intelligent computation so as to control an operation of the pump, as well as to control the gate to be opened or closed, and determine whether the outdoor gas is to be introduced into the indoor space.

4. The indoor gas exchange system according to claim 1, wherein each of the gas-guiding units comprises a ventilation channel, a pump and a gate are disposed in the ventilation channel, the pump guides the indoor gas in the indoor space to be introduced into the ventilation channel, and the central processing controller receives the outdoor air pollution data and the indoor air pollution data to perform the intelligent computation so as to control an operation of the pump, as well as to control the gate to be opened or closed, and determine whether the indoor gas is to be discharged to the outdoor space.

5. The indoor gas exchange system according to claim 3 or 4, wherein the central processing controller receives the outdoor air pollution data and the indoor air pollution data to perform the intelligent computation by connecting to a cloud processing device so as to perform artificial intelligent (AI) computation and big data comparison, therefore the cloud processing device transmits a control command intelligently and selectively to the central processing controller to control the operation of the pump and control the gate to be opened or closed.

6. The indoor gas exchange system according to claim 1, wherein the plurality of pumps are microelectromechanical systems (MEMS) pumps.

7. The indoor gas exchange system according to claim 1, wherein the processing channel is in communication with the gas separation channels, a coating separation channel and a chamber behind the coating separation channel are disposed in each of the gas separation channels, a filling material is disposed on an inner wall of the coating separation channel by coating or sputtering, so that compositions of compounds contained in the indoor gas or the outdoor gas are absorbed, separated, and introduced into the chambers; for each of the chambers, two of the gates are disposed at two ends of the chamber, a gas detector is disposed in the chamber, the gas detector is configured to detect a concentration and a property of each of the compositions of compounds contained in the indoor gas or the outdoor gas and to control the gates at the two ends of the chamber to be opened or closed.

8. The indoor gas exchange system according to claim 7, wherein the gas detector is a volatile organic compound detector capable of detecting information of carbon dioxide or total volatile organic compounds.

9. The indoor gas exchange system according to claim 7, wherein the gas detector is a formaldehyde sensor capable of detecting information of formaldehyde (HCHO) gas.

10. The indoor gas exchange system according to claim 7, wherein the gas detector is a bacterial sensor is capable of detecting information of bacteria or fungi.

11. The indoor gas exchange system according to claim 7, wherein the gas detector is a virus sensor is capable of detecting information of viruses.

12. The indoor gas exchange system according to claim 7, wherein the chamber of the gas separation channel further performs a gas conversion processing mechanism, so that the central processing controller controls the gates at the two ends of the chamber to be closed, and the compositions of compounds contained in the indoor gas or the outdoor gas introduced into the chamber are processed through a physical type or a chemical type conversion device to allow the indoor air pollution data or the outdoor air pollution data to be detected by the gas detector to have a safety detection value, and a detection result is transmitted to the central processing controller to control the gates at the two ends of the chamber to be opened.

13. The indoor gas exchange system according to claim 12, wherein the safety detection value includes at least one selected from the group consisting of a concentration of carbon dioxide (CO2) which is less than 1000 ppm, a concentration of total volatile organic compounds (TVOC) which is less than 0.56 ppm, a concentration of formaldehyde (HCHO) which is less than 0.08 ppm, a colony-forming unit per cubic meter of bacteria which is less than 1500 CFU/m3, a colony-forming unit per cubic meter of fungi which is less than 1000 CFU/m3, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, a concentration of lead which is less than 0.15 μg/m3, and any combination thereof.

14. The indoor gas exchange system according to claim 1, wherein the outdoor air pollution data and the indoor air pollution data are transmitted through a wireless communication, and the wireless communication is implemented by using a Wi-Fi module, a Bluetooth module, a radiofrequency identification module, or a near field communication module.

15. The indoor gas exchange system according to claim 1, wherein the filtering component is a high-efficiency particulate air (HEPA) filter.

16. The indoor gas exchange system according to claim 1, wherein the filtering component is a filter having a minimum efficiency reporting value (MERV) 13 or higher.

17. The indoor gas exchange system according to claim 1, wherein each of the at least one outdoor air pollution detector and the indoor air pollution detectors is an air pollution detector, the air pollution detector comprises a control circuit board, a gas detection main body, a microprocessor, and a communication device; the gas detection main body, the microprocessor, and the communication device are integrally packaged and electrically connected to the control circuit board; the microprocessor controls the operation of the gas detection main body, the gas detection main body detects the air pollution and output a detection signal, and the microprocessor receives the detection signal to perform computation to generate the indoor air pollution data and the outdoor air pollution data and provides the indoor air pollution data and outdoor air pollution data to the communication device through a wireless transmission outwardly.

18. The indoor gas exchange system according to claim 17, wherein the gas detection main body comprises:

a base, having:

a first surface;

a second surface opposite to the first surface;

a laser installation region hollowed out from the first surface to the second surface;

a gas inlet groove recessed from the second surface and located adjacent to the laser installation region, wherein the gas inlet groove has a gas inlet through hole and two lateral walls; two light penetration windows penetrate on the two lateral walls of the gas inlet groove and are in communication with the laser installation region;

a gas-guiding component installation region recessed from the second surface and in communication with the gas inlet groove, wherein a vent penetrates a bottom surface of the gas-guiding component installation region; and a gas outlet groove including a first region and a second region, wherein the first region is corresponding to the gas-guiding component installation region and is recessed from a portion of the first surface corresponding to a bottom surface of the gas-guiding component installation region; the second region is hollowed out from the first surface to the second surface in a region that is not corresponding to the gas-guiding component installation region; the gas outlet groove is in communication with the vent and has a gas outlet through hole;

a piezoelectric actuator received in the gas-guiding component installation region;

a driving circuit board covering and attached to the second surface of the base;

a laser component disposed on and electrically connected to the driving circuit board, wherein the laser component is received in the laser installation region, and a light path of a light beam emitted by the laser component passes through the light penetration windows and is orthogonal to the gas inlet groove;

a particulate sensor disposed on and electrically connected to the driving circuit board, wherein the particulate sensor is received in a position of the gas inlet groove where the path of the light beam emitted by the laser component is orthogonal to the gas inlet groove, so that the particulates in the air pollution passing through the gas inlet groove which is illuminated by the light beam of the laser component is detected by the particulate sensor; and an outer cover covering the base and having a side plate, and the side plate has a gas inlet opening and a gas outlet opening, the gas inlet opening is corresponding to the gas inlet through hole of the base, and the gas outlet opening is corresponding to the gas outlet through hole of the base;

wherein when the outer cover is covered on the base and the driving circuit board is attached to the second surface of the base, a gas inlet path is defined by the gas inlet groove and a gas outlet path is defined by the gas outlet groove, thereby the piezoelectric actuator is driven to accelerate the introduction of the air pollution outside the gas inlet through hole into the gas inlet path defined by the gas inlet groove from the gas inlet opening; the air pollution passes through the particulate sensor to detect a particle concentration of the particulates contained in the air pollution; and the air pollution discharged into the gas outlet path defined by the gas outlet groove from the vent, detected by a gas sensor, and is discharged out of the gas detection main body from the gas outlet through hole and the gas outlet opening of the base.

* * * * *